US007517035B2

(12) United States Patent
Tanaka

(10) Patent No.: US 7,517,035 B2
(45) Date of Patent: Apr. 14, 2009

(54) PRINTING DEVICE, PRINTING PROGRAM, PRINTING METHOD, IMAGE PROCESSING DEVICE, IMAGE PROCESSING PROGRAM, IMAGE PROCESSING METHOD, AND RECORDING MEDIUM IN WHICH THE PROGRAM IS STORED

(75) Inventor: Toshio Tanaka, Shiojiri (JP)

(73) Assignee: Seiko Epson Corporation (JP)

( * ) Notice: Subject to any disclaimer, the term of this patent is extended or adjusted under 35 U.S.C. 154(b) by 401 days.

(21) Appl. No.: 11/363,328

(22) Filed: Feb. 27, 2006

(65) Prior Publication Data

US 2006/0192803 A1 Aug. 31, 2006

(30) Foreign Application Priority Data

Feb. 28, 2005 (JP) ..... 2005-052595
Oct. 28, 2005 (JP) ..... 2005-315156

(51) Int. Cl.
*B41J 29/393* (2006.01)

(52) U.S. Cl. ..... 347/12; 347/15; 347/19

(58) Field of Classification Search ..... 347/12, 347/15, 41, 19, 43; 358/1.2, 1.9
See application file for complete search history.

(56) References Cited

U.S. PATENT DOCUMENTS 5,581,284 A * 12/1996 Hermanson ..... 347/43
5,587,730 A * 12/1996 Karz ..... 347/43
6,283,571 B1 9/2001 Zhou et al.
6,293,643 B1 9/2001 Shimada et al.
6,328,404 B1 12/2001 Fujimori
6,428,139 B1 * 8/2002 Silverbrook ..... 347/19
6,908,176 B2 6/2005 Koitabashi
2003/0085939 A1 5/2003 Koitabashi

FOREIGN PATENT DOCUMENTS

| | | |
|---|---|---|
| JP | 01-235655 | 9/1989 |
| JP | 08-174805 | 7/1996 |
| JP | 11-151821 | 8/1999 |
| JP | 11-254662 | 9/1999 |
| JP | 2000-79710 | 3/2000 |
| JP | 2000-190470 | 7/2000 |
| JP | 2000-225716 | 8/2000 |
| JP | 2002-019101 | 1/2002 |
| JP | 2003-136702 | 5/2003 |

* cited by examiner

*Primary Examiner*—Lamson D. Nguyen
(74) *Attorney, Agent, or Firm*—Harness, Dickey & Pierce, P.L.C.

(57) ABSTRACT

A printing device for printing a plurality of dots on a medium used for printing includes: a print head having a plurality of print elements for forming dots disposed respectively in a row direction, which is a direction of relative movement thereof with respect to the medium, and in an array direction, which is substantially orthogonal to the row direction, the print elements being capable of printing dots at positions which can be regarded as the same positions on the medium in the row direction; print element selecting unit that selects any one of the print elements being capable of printing dots at positions which can be regarded as the same positions on the medium in the row direction as a usable print element for each row in the row direction of the print head; print head controlling unit for controlling the print head so that only the usable print element selected by the print element selecting unit is used; and printing unit for executing printing using the print head controlled by the print head controlling unit.

8 Claims, 20 Drawing Sheets

DOT PATTERN AS A RESULT OF DISCHARGE DEVIATION

300

| DOT SIZE | N-VALUE | (CONCEN-TRATION) BRIGHTNESS | MULTI-LEVEL RANGE | THRESHOLD |
|---|---|---|---|---|
| NO DOT | 1 | (0)255 | 211 ~ 255 | |
| (SMALL) | 2 | (85)170 | 127 ~ 210 | ← 210 (FIRST THRESHOLD) |
| (MEDIUM) | 3 | (170)85 | 43 ~ 126 | ← 126 (SECOND THRESHOLD) |
| (LARGE) | 4 | (255)0 | 0 ~ 42 | ← 42 (THIRD THRESHOLD) |

400

| ADDRESS | | DATA |
|---|---|---|
| 0000 0000 0000 0000 | 0000 0001 | 0000 0001 |
| 0000 0000 0000 0001 | 0000 0001 | 0000 0010 |
| 0000 0000 0000 0010 | 0000 0001 | 0000 0001 |
| 0000 0000 0000 0011 | 0000 0001 | 0000 0001 |
| 0000 0000 0000 0100 | 0000 0001 | 0000 0001 |
| 0000 0000 0000 0101 | 0000 0001 | 0000 0010 |
| • | | |
| • | | |
| • | | |
| • | | |
| 0000 0001 0111 0010 | 0000 0011 | 0000 0011 |
| 0000 0001 0111 0011 | 0000 0011 | 0000 0001 |
| • | | |
| • | | |
| • | | |
| • | | |
| POSITION (COUNTER) | DOT SIZE | |

NOZZLE ARRAY IDENTIFIER

FIG.23

PRINTING DEVICE, PRINTING PROGRAM, PRINTING METHOD, IMAGE PROCESSING DEVICE, IMAGE PROCESSING PROGRAM, IMAGE PROCESSING METHOD, AND RECORDING MEDIUM IN WHICH THE PROGRAM IS STORED

RELATED APPLICATIONS

This application claims priority to Japanese Patent Application Nos. 2005-052595 filed Feb. 28, 2005 and 2005-315156 filed Oct. 28, 2005 which are hereby expressly incorporated by reference herein in their entirety.

BACKGROUND

1. Technical Field

The present invention relates to a printing device such as a facsimile device, a copying machine, or a printer for office automation equipment and, more specifically, to a printing device, a printing program, a printing method, an image processing device, an image processing program, an image processing method, and a recording medium in which the program is stored in a system in which predetermined characters or images are drawn on printer sheet (recording material, medium) by discharging fine particles of liquid ink in a plurality of colors, so-called inkjet system.

2. Related Art

A printer in which such an inkjet system is employed (hereinafter, referred to as "inkjet printer") is widely used not only in offices, but also among general users in tandem with penetration of personal computers or digital cameras since it is generally cost effective and can provide a high-quality color printing easily.

The inkjet printer is adapted to create a desired printed material by moving a movable member including an ink cartridge and a print head integrally therewith, which is called "carriage" or the like, on a printing medium (paper) reciprocally in a lateral direction with respect to a paper-feeding direction while discharging (injecting) particles of liquid ink from a nozzle of the print head in dots, thereby drawing predetermined characters or images on the printer sheet. When four of such ink cartridges for four colors including black (yellow, magenta, cyan), and the print heads for the respective colors are provided on the carriage, not only monochrome printing, but also full color printing can be achieved easily by combining these colors (in addition, combinations of six, seven, and eight colors with light cyan or light magenta added thereto have also come into practical use).

In the inkjet printer of the type in which printing is executed by moving the print heads on the carriage reciprocally in the lateral direction with respect to the paper-feeding direction (a widthwise direction of the printer sheet), it is necessary to cause the print heads to reciprocate from several tens times to more than one hundred times in order to achieve a good-looking printing on one page. Therefore, it has a drawback such that a significantly long printing time is required in comparison with printing device of other system, such as a laser printer in which an electrophotographic technology such as a copying machine is employed.

In contrast, in the inkjet printer of a type in which an elongated print head having the same length as the width of the printer sheet is arranged so that the carriage is not used, and hence it is not necessary to move the print head widthwise of the printer sheet. Therefore, so-called single-pass printing is achieved, and hence high-speed printing as with the laser printer is enabled. In addition, since the carriage to mount the print head and a drive system for moving the same are not necessary, reduction of the size and the weight of an enclosure of the printer is possible. Furthermore, it has an advantage such that quietness is significantly improved. The inkjet printer of the former type is generally called as "multi-pass type printer" and the one of the latter type is generally called as "line-head type printer".

The print head which is essential in the inkjet printer includes minute nozzles on the order of 10-70 μm in diameter at predetermined intervals arranged in series or in multi-stage in the printing direction. Therefore, there may be a case in which directions of ink discharge from some of the nozzles are inclined or the positions of the nozzles are arranged at positions deviated from ideal positions due to manufacturing error and, consequently, dots formed by these nozzles are deviated from target positions, which is called as a "discharge deviation phenomenon".

Consequently, there is a case in which defective printing result, which is called as "banding phenomenon", occurs at a part of the printed result which corresponds to defective nozzles and hence the printing quality is significantly lowered. In other words, when the discharge deviation phenomenon occurs, distances between adjacent dots become uneven. When the distances between the adjacent dots are long, "white bands (when the printer sheet is white)" are generated, and when the distances of the adjacent dots are short, "dark bands" are generated.

In particular, such the banding phenomenon tends to occur often in the "line-head type printer" in which the print head is fixed (single-pass printing) and the number of nozzles is significantly larger than the multi-pass type printer in comparison with the above-described "multi-pass type printer" (The multi-pass type printer has a technique that reduces the white bands to an invisible level using a mechanism of reciprocating the print head many times).

Therefore, in order to prevent a sort of defective printing due to the "banding phenomenon", study and development in a way pertaining to hardware such as improvement in technology of manufacturing the print head or improvement of design have been carried out. However, it is difficult to provide a print head in which the occurrence of the "banding phenomenon" is completely eliminated because of the manufacturing cost, printing quality, and technological reasons.

Therefore, in the status quo, in addition to the improvement in a way pertaining to hardware as described above, a technology to reduce the "banding phenomenon" in a way pertaining to software, such as printing control as shown below is employed in parallel.

In order to cope with fluctuations of the nozzles or non-discharging of ink, for example, in JP-A-2002-19101 and JP-A-2003-136702, a shading correction technique is used for portions with less density to cope with the fluctuations of the heads, and other colors are used for portions of high density to reduce the banding or fluctuations to an invisible level.

In JP-A-8-174805, there is disclosed a method in which an inkjet recording head including a first array of discharging ports and a second array of discharging ports each having a plurality of discharging ports is employed, so that when a defect occurs in any of discharging ports in an array, the banding phenomenon due to defective discharge is avoided by using discharging ports of the other array instead.

However, in the method of alleviating the banding phenomenon or fluctuations by using other colors as in JP-A-2002-19101 or JP-A-2003-136702, a color hue of parts applied with such processing may change, and hence it is not suitable for printing such as color photo image printing in which high definition and high quality are required.

When the method of allocating information of non-discharging nozzle to left and right nozzles for the portion of high density to avoid the "white banding phenomenon" is applied to the discharge deviation phenomenon described above, the white bands can be reduced. However, the banding remains disadvantageously in the part with high density.

According to the method disclosed in JP-A-8-174805, the banding phenomenon due to the defective discharge can be avoided. However, the banding phenomenon due to the discharge deviation phenomenon cannot be avoided.

SUMMARY

An advantage of some aspect of the invention is, in particular, to provide a novel printing device, a printing program, a printing method, an image processing device, an image processing program, an image processing method and a recording medium in which the program is stored that can eliminate the banding due to the discharge deviation phenomenon or reduce the same to an almost invisible level.

Mode 1

A printing device according to Mode 1 is a printing device for printing a plurality of dots on a medium used for printing including: a print head having a plurality of print elements for forming dots disposed respectively in a row direction, which is a direction of relative movement thereof with respect to the medium, and in an array direction, which is substantially orthogonal to the row direction, the print elements being capable of printing dots at positions which can be regarded as the same positions on the medium in the row direction; print element selecting unit that selects any one of the print elements being capable of printing dots at positions which can be regarded as the same positions on the medium in the row direction as a usable print element for each row in the row direction of the print head; print head controlling unit for controlling the print head so that only the usable print element selected by the print element selecting unit is used; and printing unit for executing printing using the print head controlled by the print head controlling unit.

In this arrangement, since a normal print element which is free of discharge deviation or, a print element with the least amount of discharge deviation if occurred can be selected and used as a usable print element, a banding phenomenon such as "white bands" or "dark bands" due to the discharge deviation phenomenon can be eliminated or reduced to an almost invisible level.

The term "print element" in this mode corresponds to each "nozzle" that discharges ink for an inkjet print head and to each "heat element" that sublimates paint for a dye sublimation print head (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "print element in an array direction" represents the one that can print dots (printed material) of predetermined resolution only with the print element that constitutes an array of print elements (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

Since there are not only the print elements that print dots always when executing printing operation, but also print elements that do not print dots depending on contents of print data, the term "usable print element" is a concept including the latter print elements (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "array direction" represents a direction in which the print elements are arranged in each array of print elements, and the term "row direction" represents so-called paper-feeding direction in the case of the line-head type print head, and a direction orthogonal to the array direction in the case of the multi-pass type print head (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "banding phenomenon" represents defective printed result such as "white bands" or "dark bands" generated by the "discharge deviation phenomenon" (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "discharge deviation phenomenon" represents a phenomenon, being different from a phenomenon that some print elements simply fail to discharge ink as described above, in which ink is discharged but the directions of ink discharge from some of the print-elements are inclined or the like, whereby the dots are formed at positions displaced from target positions (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

The term "white bands" represents a part (area) where a phenomenon in which distances between adjacent dots are increased with respect to a predetermined distance due to the "discharge deviation phenomenon" occurs consecutively in the row direction, whereby a base color of the printing medium comes into prominence as bands. The term "dark bands" represents a part (area) where a phenomenon in which distances between adjacent dots are reduced with respect to the predetermined distance due to the "discharge deviation phenomenon" occurs consecutively in the row direction, whereby the base color of the medium is hidden, the corresponding part appears to be dark due to the reduction of the distance between the dots, or some of dots formed at displaced positions are overlapped with the normal dots whereby the overlapped portions come into prominent as dark bands (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

Mode 2

Preferably, the printing device according to Mode 2 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

In this mode, the pattern obtained by forming dots with the print elements is printed, and using the printed result, the information for selecting the usable print elements for the respective rows is generated.

Accordingly, the optimal usable print elements with less amount of discharge deviation can be selected for the respective rows of the dots easily and accurately.

The term "resolution of the print head" represents, when the print head is arranged orthogonally to the printing direction, a print element pitch (inter-nozzle distance), and when the print head is arranged obliquely with respect to the printing direction, the print element pitch (inter-nozzle distance) viewed in the printing direction (this is also applied to a mode relating to a "printing device", a mode relating to a "printing program", a mode relating to a "printing method", a mode relating to an "image processing device", a mode relating to an "image processing program", a mode relating to an "image processing method", and a mode relating to a "recording medium with the program stored therein", and a description in the section of summary).

Mode 3

Preferably, the printing device according to Mode 3 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, obtaining absolute values of amounts of displacement from the respective virtual resolution lines for the respective rows in the row direction, combining the absolute values of the respective dots in the array direction into a tree structure, and selecting print elements corresponding to a combination of dots whose sum of the absolute values is the smallest as the usable print elements.

Accordingly, optimal usable print elements can be selected for the respective dot rows easily and accurately.

Mode 4

Preferably, the selection information generating unit generates information about the print elements for the respective dot sizes so that the respective print elements of the print head can print dots in different sizes, and the print element selecting unit can select the usable print elements for the respective dot sizes from the print head.

Accordingly, optimal usable print elements can be selected in combination so as to be capable of coping with failure characteristics which differ depending on the dot size (discharged amount).

Mode 5

Preferably, the print head is a line-head type print head having a length corresponding to a width of the medium so that printing can be achieved by a single scan without being moved in widthwise of the medium.

Accordingly, the banding phenomenon which is liable to occur specifically when the line-head type print head which achieve printing by a single-pass operation as described above is used can be eliminated or reduced to an invisible level.

Mode 6

Preferably, the print head is a multi-pass type print head having a length shorter than the width of the medium and reciprocates widthwise of the medium.

Although the above-described banding phenomenon is prominent in the case of the line-head type print head, it also occurs in the case of the multi-pass type print head. Therefore, by applying the technique described in any one of Mode 1 to Mode 4 to the multi-pass type print head, the banding phenomenon occurred in the case where the multi-pass type print head is used can be eliminated or reduced to an invisible level.

In the case of the multi-pass type print head, the banding phenomenon as described above can be avoided by, for example, repeating scanning of the print head. However, by applying the technique according to Mode 1 to Mode 4, it is not necessary to cause the print head to scan the same position many times, and hence further efficient printing process is realized.

Mode 7

A printing program according to Mode 7 is a printing program for performing a printing operation by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction, wherein the printing program causing a computer to function as print element selecting unit that selects any one of the print elements being capable of printing dots at positions which can be regarded as the same positions on the medium in the row direction as a usable print element for each row in the row direction of the print head.

Accordingly, the banding phenomenon such as "white bands" or "dark bands" due to the discharge deviation phenomenon can be eliminated or reduced to an invisible level as in Mode 1.

Most of the printing device currently in the market such as an inkjet printer includes a computer system composed of a central processing unit (CPU), storage devices (RAM, ROM), and an input/output device, and the respective unit can be realized by a software using the computer system. Therefore, the respective unit can be realized economically and easily in comparison with the case in which the respective unit are realized by preparing a specific hardware. In addition, version upgrade by modifying or improving functions can be achieved easily by rewriting part of the program.

Mode 8

Preferably, the printing program according to Mode 8 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

Accordingly, optimal usable print elements with less amount of discharge deviation can be selected for the respective rows of the dots easily and accurately as in Mode 2.

Since the respective unit can be realized by the software using the computer system provided in most of the printing device currently in the market as in Mode 7, the respective unit can be realized economically and easily in comparison with the case in which the respective unit are realized by preparing a specific hardware. In addition, version upgrade by modifying or improving functions can be achieved easily by rewriting part of the program.

Mode 9

Preferably, the printing program according to Mode 9 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, obtaining absolute values of amounts of displacement from the respective virtual resolution lines for the respective rows in the row direction, combining the absolute values of the respective dots in the array direction into a tree structure, and selecting print element corresponding to a combination of dots whose sum of absolute the values is the smallest as the usable print element.

Accordingly, optimal usable print elements with less amount of discharge deviation can be selected for the respective rows of the dots easily and accurately as in Mode 3.

Since the respective unit can be realized by the software using the computer system provided in most of the printing device currently in the market as in Mode 7, the respective unit can be realized economically and easily in comparison with the case in which the respective unit are realized by preparing a specific hardware. In addition, version upgrade by modifying or improving functions can be achieved easily by rewriting part of the program.

Mode 10

Preferably, the selection information generating unit generates information about the print elements for the respective dot sizes so that the respective print elements of the print head can print dots in different sizes, and the print element selecting unit can select the usable print elements for the respective dot sizes from the print head.

Accordingly, optimal usable print elements can be selected in combination so as to be capable of coping with failure characteristics which differ depending on the dot size (discharged amount) as in Mode 4. In addition, since the respective unit can be realized by the software using the computer system provided in most of the printing device currently in the market as in Mode 7, the respective unit can be realized economically and easily in comparison with the case in which the respective unit are realized by preparing a specific hardware. In addition, version upgrade by modifying or improving functions can be achieved easily by rewriting part of the program.

Mode 11

A computer readable recording medium in Mode 11 is a computer readable recording medium in which the printing program stated in any one of Mode 7 to Mode 10 is stored.

Accordingly, the printing program as stated in any one of Mode 7 to Mode 10 can be provided easily and reliably for a consumer such as a user via the computer readable recording medium such as a CD-ROM, a DVD-ROM, an FD, or a semiconductor chip.

Mode 12

A printing method according to Mode 12 is a printing method for performing a printing operation by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction including: a print element selecting step for selecting any one of the print elements being capable of printing dots at positions which can be regarded as the same positions on the medium in the row direction as a usable print element for each row in the row direction of the print head; a print head controlling step for controlling the print head so that only the usable print element selected by the print element selecting step is used; and a printing step for executing printing using the print head controlled by the print head controlling step.

The print element selecting step for selecting any one of the print elements being capable of printing the dots at positions which can be regarded as the same positions on the medium in the row direction as the usable print element for each row in the row direction of the print head can be performed by using the CPU, the output device and the storage device in the hardware structure, the print head control step for controlling the print head so that only the usable print element selected by the print element selecting step is used can be performed also by the CPU, and the printing step for executing printing using the print head controlled by the print head controlling step can be performed by the output device.

Accordingly, the banding phenomenon such as "white bands" or "dark bands" due to the discharge deviation phenomenon can be eliminated or reduced to an invisible level as in Mode 1.

Mode 13

Preferably, the printing method according to Mode 13 includes a selection information generating step for generating information for selecting usable print element by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

Accordingly, optimal usable print elements with less amount of discharge deviation can be selected for the rows of the dots easily and accurately as in Mode 2.

Mode 14

Preferably, the printing method according to Mode 14 includes a selection information generating step for generating information for selecting usable print elements by determining any one of the dots as a reference from a pattern of dots formed by the print elements of the print head in the array direction, assuming vertical resolution lines at regular pitch in the array direction according to resolution of the print head, obtaining absolute values of amounts of displacement from the respective virtual resolution lines for the respective rows in the row direction, combining the absolute values of the respective dots in the array direction into a tree structure, and selecting print elements corresponding to a combination of dots whose sum of the absolute values is the smallest as the usable print elements.

Accordingly, optimal usable print elements with less amount of discharge deviation can be selected for the respective rows of the dots easily and accurately as in Mode 3.

Mode 15

Preferably, the selection information generating step generates information about the print elements for the respective dot sizes so that the respective print elements of the print head can print dots in different sizes, and the print element selecting unit can select the usable print elements for the respective dot sizes from the print head.

Accordingly, optimal usable print elements can be selected in combination so as to be capable of coping with failure characteristics which differ depending on the dot size (discharged amount) as in Mode 4.

Mode 16

An image processing device according to Mode 16 is an image processing device that forms an image by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction including: print element selecting unit that selects any one of the print elements being capable of printing dots at positions which can be regarded as the same positions on the medium in the row direction as a usable print element for each row in the row direction of the print head; and print head controlling unit that controls the print head so that only the usable print element selected by the print element selecting unit is used.

Accordingly, the banding phenomenon such as "white bands" or "dark bands" due to the discharge deviation phenomenon can be eliminated or reduced to an almost invisible level as in Mode 1.

Since it can be realized independently from the output device, it is not necessary to modify the existing output device significantly for realization. In addition, since the respective unit can be realized on the software, it can be realized by the information processing device such as a multi-purpose personal computer.

The term "image" of the "image processing device" is not an image in the narrow sense, and represents an image (page) to be printed including documents and photos.

Mode 17

Preferably, the image processing device according to Mode 17 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

Accordingly, optimal usable print elements with less amount of discharge deviation can be selected for the respective rows of the dots easily and accurately as in Mode 2.

Since it can be realized independently from the output device, it is not necessary to modify the existing output device significantly for realization. In addition, since the respective unit can be realized on the software, it can be realized by the information processing device such as a multi purpose personal computer.

Mode 18

Preferably, the image processing device according to Mode 18 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, obtaining absolute values of amounts of displacement from the respective virtual resolution lines for the respective rows in the row direction, combining the absolute values of the respective dots in the array direction into a tree structure, and selecting print element corresponding to a combination of dots whose sum of the absolute values is the smallest as the usable print element.

Accordingly, optimal usable print elements with less amount of discharge deviation can be selected for the respective rows of the dots easily and accurately as in Mode 3.

Since it can be realized independently from the output device, it is not necessary to modify the existing output device significantly for realization. In addition, since the respective unit can be realized on the software, it can be realized by the information processing device such as a multi-purpose personal computer.

Mode 19

Preferably, the selection information generating step generates information about the print elements for the respective dot sizes so that the respective print elements of the print head can print dots in different sizes, and the print element selecting unit can select the usable print elements for the respective dot sizes from the print head.

Accordingly, optimal usable print elements can be selected in combination so as to be capable of coping with failure characteristics which differ depending on the dot size (discharged amount) as in Mode 4.

Since it can be realized independently from the output device, it is not necessary to modify the existing output device significantly for realization. In addition, since the respective unit can be realized on the software, it can be realized by the information processing device such as a multi-purpose personal computer.

Mode 20

An image processing program according to Mode 20 is an image processing program for forming an image by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction, wherein the program causing a computer to function as print element selecting unit that selects any one of the print elements being capable of printing dots at positions which can be regarded as the same positions on the medium in the row direction as a usable print element for each row in the row direction of the print head and print head controlling unit that controls the print head so that only the usable print element selected by the print element selecting unit is used.

Accordingly, the banding phenomenon such as "white bands" or "dark bands" due to the discharge deviation phenomenon can be eliminated or reduced to an almost invisible level as in Mode 1.

Since the respective unit can be realized on the software, it can be realized by the information processing device such as a multi-purpose personal computer.

Mode 21

Preferably, the image processing program according to Mode 21 includes selection information generating unit that generates information for selecting usable print elements by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

Accordingly, optimal usable print elements with less amount of discharge deviation can be selected for the respective rows of the dots easily and accurately as in Mode 2.

Since the respective unit can be realized on the software, it can be realized by the information processing device such as a multi-purpose personal computer.

Mode 22

Preferably, the image processing program according to Mode 22 includes selection information generating unit that generates information for selecting usable print elements by determining any one of dots as a reference from a pattern of dots formed by the print elements of the print head in the array direction, assuming vertical resolution lines at regular pitch in the array direction according to the resolution of the print head, obtaining absolute values of amounts of displacement from the respective virtual resolution lines for the respective rows in the row direction, combining the absolute values of the respective dots in the array direction into a tree structure, and selecting print element corresponding to a combination of dots whose sum of the absolute values is the smallest as the usable print element.

Accordingly, optimal usable print elements with less amount of discharge deviation can be selected for the respective rows of the dots easily and accurately as in Mode 3.

Since the respective unit can be realized on the software, it can be realized by the information processing device such as a multi-purpose personal computer.

Mode 23

Preferably, the selection information generating unit generates information about the print elements for the respective dot sizes so that the respective print elements of the print head can print dots in different sizes, and the print element selecting unit can select the usable print elements for the respective dot sizes from the print head.

Accordingly, optimal usable print elements can be selected in combination so as to be capable of coping with failure characteristics which differ depending on the dot size (discharged amount) as in Mode 4.

Since the respective unit can be realized on the software, it can be realized by the information processing device such as a multi-purpose personal computer.

Mode 24

A computer readable recording medium according to Mode 24 is a computer readable recording medium in which the image processing program stated in any one of Modes 20 to 23 is stored.

Accordingly, the image processing program as stated in any one of Mode 20 to Mode 23 can be provided easily and reliably for a consumer such as a user via the computer readable recording medium such as a CD-ROM, a DVD-ROM, an FD, or a semiconductor chip.

Mode 25

An image processing method according to Mode 25 is an image processing method for forming an image by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction including: a print element selecting step for selecting any one of the print elements being capable of printing dots at positions which can be regarded as the same positions on the medium in the row direction as a usable print element for each row in the row direction of the print head; and a print head controlling step for controlling the print head so that only the usable print element selected by the print element selecting unit is used.

The print element selecting step for selecting any one of the print elements being capable of printing the dots at positions which can be regarded as the same positions on the medium in the row direction as the usable print element for each row in the row direction of the print head can be performed by using the CPU, the output device and the storage device in the hardware structure, the print head control step for controlling the print head so that only the usable print element selected by the print element selecting step is used can be performed also by the CPU, and the printing step for executing printing using the print head controlled by the print head controlling step can be performed by the output device.

Accordingly, the banding phenomenon such as "white bands" or "dark bands" due to the discharge deviation phenomenon can be eliminated or reduced to an invisible level as in Mode 1.

Mode 26

Preferably, the image processing method according to Mode 26 includes a selection information generating step for generating information for selecting usable print elements by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

Accordingly, optimal usable print element with less amount of discharge deviation can be selected for the respective rows of the dots easily and accurately as in Mode 2.

Mode 27

Preferably, the image processing method according to Mode 27 includes a selection information generating step for generating information for selecting usable print elements by determining any one of dots as a reference from a pattern of dots formed by the print elements of the print head in the array direction, assuming vertical resolution lines at regular pitch in the array direction according to resolution of the print head, obtaining absolute values of amounts of displacement from the respective virtual resolution lines for the respective rows in the row direction, combining the absolute values of the respective dots in the array direction into a tree structure, and selecting print element corresponding to a combination of dots whose sum of the absolute values is the smallest as the usable print element.

Accordingly, optimal usable print elements with less amount of discharge deviation can be selected for the respective rows of the dots easily and accurately as in Mode 3.

Mode 28

Preferably, the selection information generating step generates information about the print elements for the respective dot sizes so that the respective print elements of the print head can print dots in different sizes, and the print element selecting step can select the usable print elements for the respective dot sizes from the print head.

Accordingly, optimal usable print elements can be selected in combination so as to be capable of coping with failure characteristics which differ depending on the dot size (discharged amount) as in Mode 4.

BRIEF DESCRIPTION OF THE DRAWINGS

The invention will be described with reference to the accompanying, drawings, wherein like numbers reference like elements.

FIG. 23 is a drawing showing an example of a usable nozzle table according to the second embodiment.

DESCRIPTION OF EXEMPLARY EMBODIMENTS

Referring now to attached drawings, exemplary embodiments of the invention will be described in detail.

FIG. 1 to FIG. 18 show a printing device 100, a printing program, a printing method, an image processing device, an image processing program, an image processing method, and a recording medium which is readable by a computer according to a first embodiment.

In description shown below, a nozzle is used as a print element for forming dots, a row direction which is a direction of relative movement of a print head with respect to a medium is referred to as a printing direction and an array direction which is substantially orthogonal to the row direction is referred to as a primary scanning direction.

Figure 1:
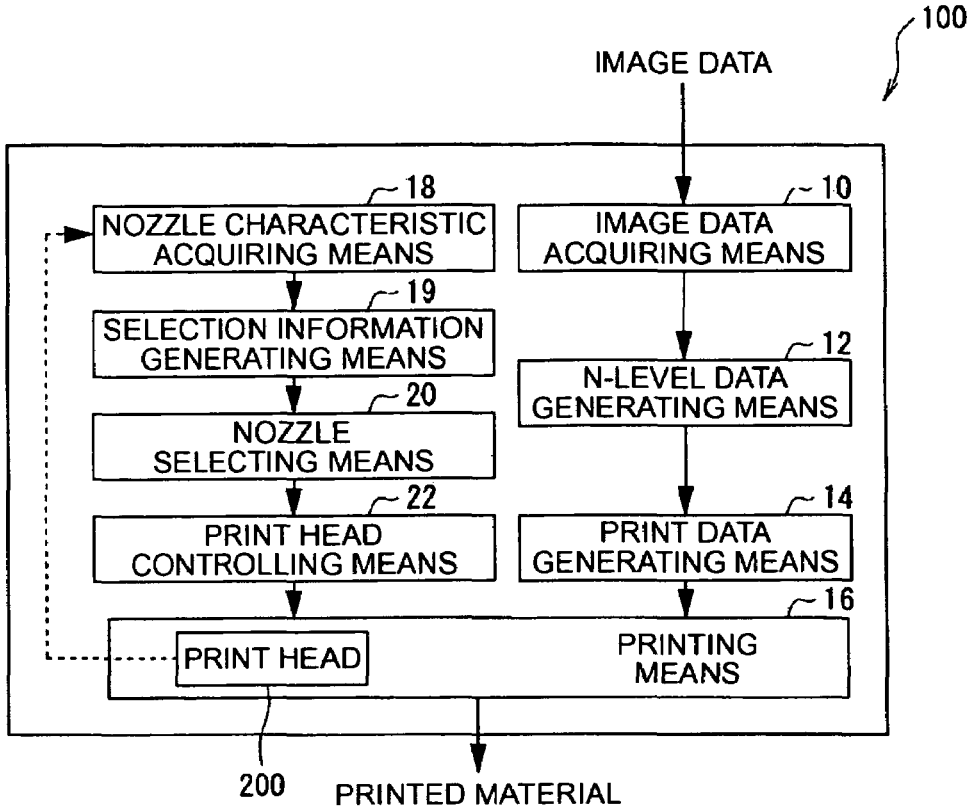
FIG. 1 is a functional block diagram showing a first embodiment of a printing device according to the present invention.

FIG. 1 is a functional block diagram showing the printing device 100 according to a first embodiment of the invention.

As shown in the drawing, the printing device 100 includes a print head 200 having a plurality of nozzles, image data acquiring unit 10 that acquires multi-level image data provided for printing; N-level data generating unit 12 that generates N-level data by converting the image data acquired by the image data acquiring unit 10 into an N-level ($N \geqq 2$); print data generating unit 14 that generates print data from the N-level data generated by the N-level data generating unit 12; inkjet printing unit 16 that executes printing on the basis of the print data generated by the print data generating unit 14; nozzle characteristic acquiring unit 18 that acquires nozzle characteristic of the print head 200; selection information generating unit 19 that generates selection information for selecting nozzles on the basis of nozzle information acquired by the nozzle characteristic acquiring unit 18; nozzle selecting unit 20 that selects a usable nozzle on the basis of the selection information generated by the selection information generating unit 19; print head controlling unit 22 that controls the print head 200 so that only the usable nozzle selected by the nozzle selecting unit 20 is used. The respective components will be described in detail.

The print head 200 which is applied to the invention will now be described.

Figure 3:
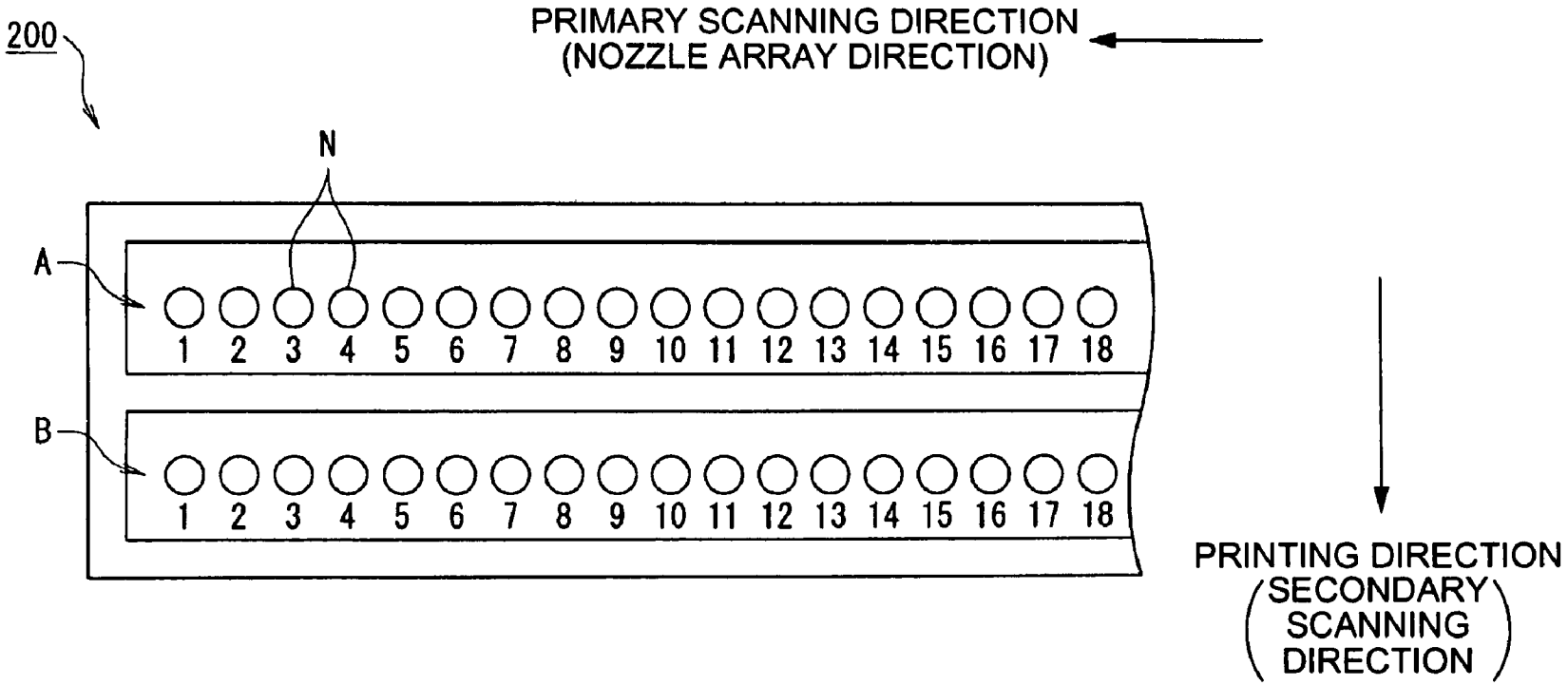
FIG. 3 is a partly enlarged bottom view showing a structure of a print head according to the invention.
Figure 4:
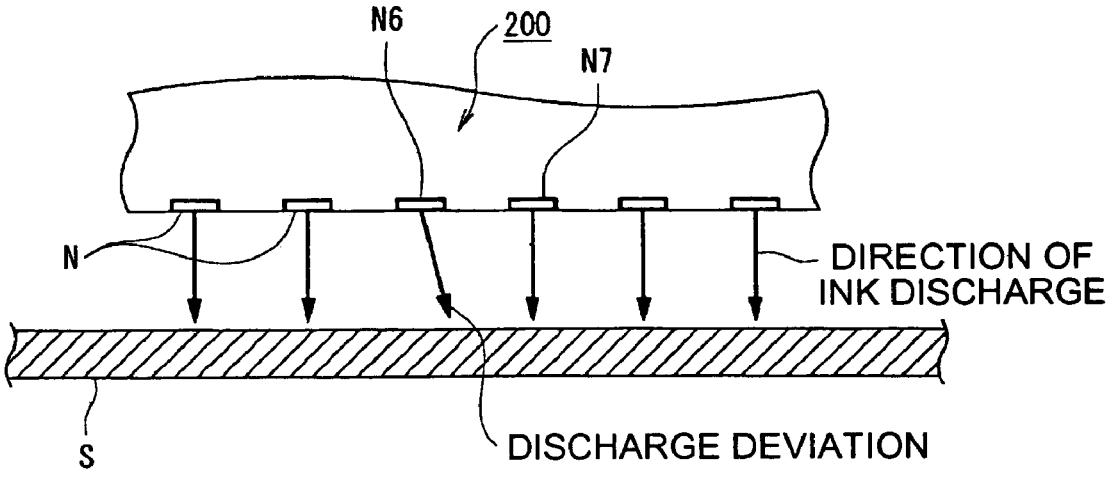
FIG. 4 is a partly enlarged side view showing the structure of the print head according to the invention.

FIG. 3 is a partly enlarged bottom view showing a structure of the print head 200, and FIG. 4 is a partly enlarged side view of FIG. 3.

As shown in the same drawing, the print head 200 has an enlarged structure extending widthwise of a printer sheet used for of so-called a line-head type printer, and includes a pair of nozzle arrays (nozzle modules) A, B each including a plurality of nozzles N (eighteen nozzles are shown in the drawing) that discharge specifically black (K) ink linearly arranged at predetermined intervals in the primary scanning direction combined in front and back with respect to the printing direction.

In a case of the print head 200 for performing color printing, additional three pairs of nozzle arrays are arranged integrally so as to be overlapped in the printing direction (secondary scanning direction), and these additional nozzle arrays are yellow nozzle arrays each having the plurality of nozzles N for discharging specifically yellow (Y) ink and being linearly arranged in the primary scanning direction, magenta nozzle arrays each including a plurality of nozzles N for discharging specifically magenta (M) ink and being linearly arranged also in the primary scanning direction, and cyan nozzle arrays each including a plurality of nozzles N for discharging specifically cyan (C) ink and being linearly arranged also in the primary scanning direction.

In other words, in a case of the print head 200 which is intended for monochrome images, only one pair of black (K) nozzle arrays A and B are provided as shown in FIG. 3, and in the case of the print head 200 that is intended for color images, pairs of nozzle arrays are additionally provided for the respective colors; yellow, magenta, and cyan.

FIG. 4 shows the nozzle array A, which is one of the nozzle arrays A and B, viewed from the side, showing that a discharge deviation phenomenon occurs in a sixth nozzle N6 from the left, and hence ink from the nozzle N6 is discharged obliquely, whereby a dot is printed (ink-landing) near a normal nozzle N7 located next thereto.

Figure 5:
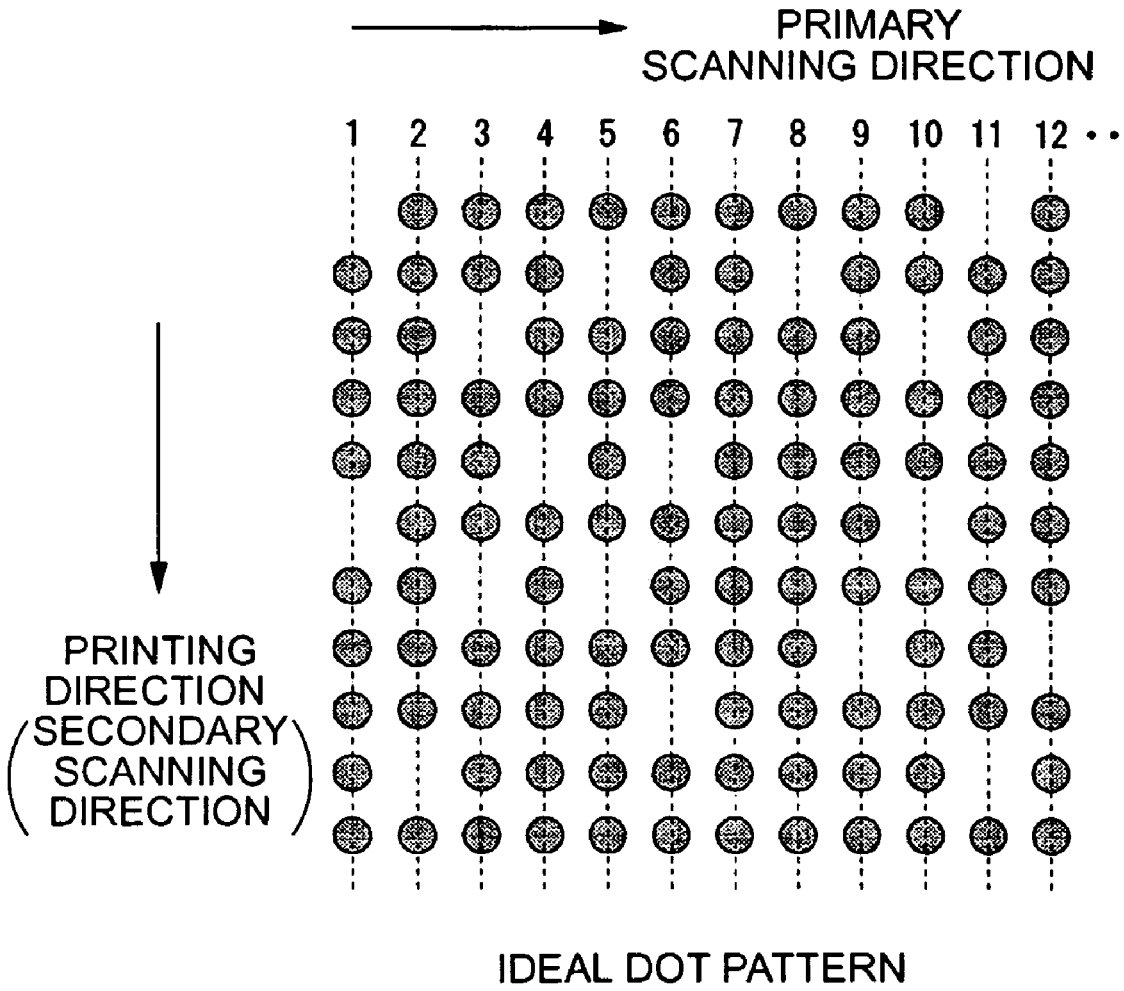
FIG. 5 is a conceptual drawing showing an example of an ideal dot pattern in which a discharge deviation phenomenon does not occur.

Therefore, when printing is performed only with the nozzle array A, in a state in which the discharge deviation is not occurred as shown in FIG. 5, all the dots are printed on their prescribed positions (ideal dot pattern). However, when the discharge deviation phenomenon occurs in the sixth nozzle N6 from the left as shown in FIG. 6, the positions of the dots printed thereby are shifted toward the normal nozzle N7 located next thereto by a distance "a" from the intended printing positions, whereby a banding phenomenon is resulted on a line near the nozzle N6.

Figure 6:
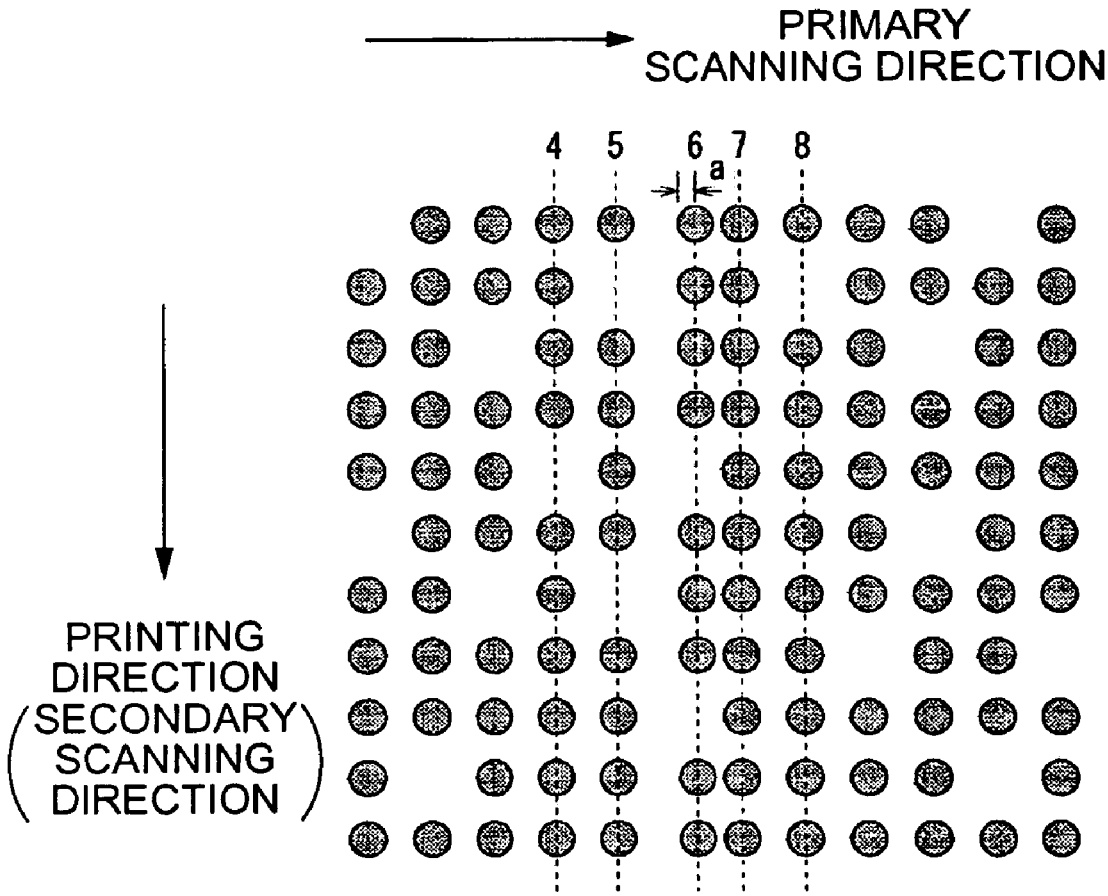
FIG. 6 is a conceptual drawing showing an example of a dot pattern formed by the discharge deviation phenomenon of one nozzle.

In FIG. 4 and FIG. 6, examples in which the discharge deviation phenomenon occurs on only one nozzle N are shown. However, as described later, in the actual print head 200, the discharge deviation phenomenon occurs normally in all directions in almost all nozzles N in any way. Therefore, an example in which the discharge deviation phenomenon occurs only in the direction of the array of the nozzles (primary scanning direction) is specifically shown in the following description. The image data acquiring unit 10 provides a function to acquire multi-level (M-level) color image data to be printed, which are supplied from a print instruction device (not shown) such as a personal computer (PC) or a printer server connected to the printing device 100 via a network, or read and acquire the same directly from a scanner or an image (data) reading device such as a CD-ROM drive, not shown. When the acquired multi-level color image data is multi-level RGB data, for example, image data in which a pixel value (brightness value) for each color (R, G and B) per pixel is represented by 8-bits, 256 (0-255) gradations, a function to apply a color conversion processing to the image data and convert the same into multi-level CMYK (in the case of four colors) data corresponding to the respective ink of the print head 200 is also carried out.

The N-level data generating unit 12 is adapted to provide a function to convert the multi-level image data acquired by the image data acquiring unit 10 into an N-level to generates N-level image data.

More specifically, the pixel value (density value) of each pixel in the image data acquired by the image data acquiring unit 10 is specified as 8-bits, 256 gradations, and when it is converted into a four-level with the gradation: N=4, the pixel value of each pixel is classified into four using three thresholds as shown in a dot/gradation conversion table 300 shown in FIG. 7.

Figures 7, 8:
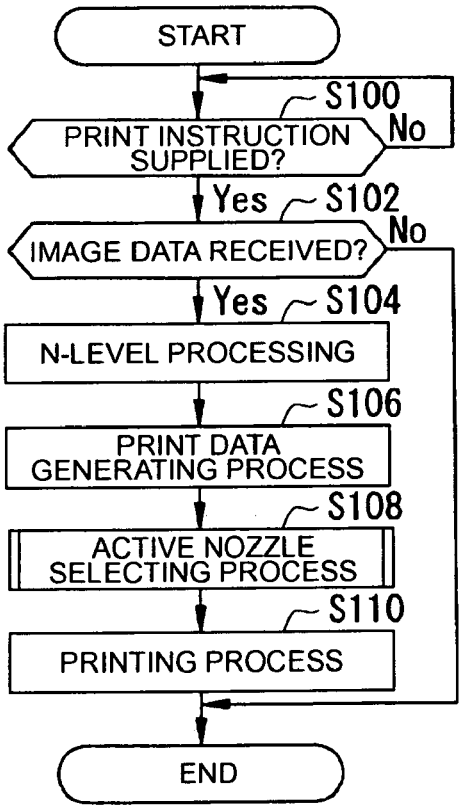
FIG. 7 is a drawing showing an example of a conversion table showing a relation between a pixel value and N-level (gradation) and N-level (gradation) and dot sizes.
FIG. 8 is a flowchart showing a flow of a printing process according to the first embodiment.

A right column of the dot/gradation conversion table 300 in FIG. 7 shows a relation between thresholds used for converting the multi-level pixel value into the four-level with the gradation: N=4 and the respective pixel values.

In other words, according to the dot/gradation conversion table 300, when the pixel value (brightness value) of each pixel of the multi-level image data is specified as 8-bits (0-255), three thresholds such as "42 (first threshold)", "126 (second threshold)", and "210 (third threshold)" are used, and the pixel value is converted into four-level with the gradation value=1 (brightness "255") when the pixel value is "211-255", with the gradation value=2 (brightness "170") when the pixel value is "127-210", with the gradation value=3 (brightness "85") when the pixel value is "43-126", and with the gradation value=4 (brightness "0") when the pixel value is "0-42".

The print data generating unit 14 is adapted to provide a function to set corresponding dot for each pixel of the N-level data, which is converted into the N-level for each pixel, for creating print data to be used in the inkjet printing unit 16.

A left column of the dot/gradation conversion table 300 in FIG. 7 is a reference drawing showing a relation between the pixel value of each pixel of the N-level data used in the print data generating unit 14 and the dot size.

In the example shown in the drawing, when "gradation: N=4", that is, conversion into the four-level is employed, and the "density value" is selected as the pixel value, the dot size when "gradation level=1" is converted into "no dot", the dot size when "gradation level=2" is converted into a "small dot" in which a surface area of the dot is the smallest, the dot size when "gradation level=3" is converted into a "medium dot" which is slightly larger than the small dots, and the dot size when "gradation level=4" is converted into a "large dot" in which the surface area of the dot is the largest, respectively. When the "density value" is employed as the pixel value, the pixel value is converted into the dot in the inverse relation from the "brightness value".

The printing unit 16 is an inkjet printer configured in such a manner that ink is injected into dots from the nozzle arrays A and B formed on the print head 200 while moving one or both of a printing medium (paper) S and the print head 200, thereby forming a predetermined image composed of a number of dots on the printing medium S, including, in addition to the print head 200, publicly known components such as a print head feed mechanism, not shown, for causing the print head 200 to reciprocate on the printing medium S in its widthwise direction (in case of the multi-pass type), the paper feed mechanism, not shown, for moving the printing medium S, and a print head controller mechanism, not shown, for controlling ink discharge of the print head 200 on the basis of the print data or the print head controlling unit 22.

The nozzle characteristic acquiring unit 18 provides a function to acquire nozzle characteristics of the print head 200, and a function to print (dot formation) actually using the printing unit 16 and all the nozzles N of the respective nozzle arrays A, B of the print head 200, and present the printed result to the nozzle selecting unit 20 (detailed example will be shown later). The nozzle characteristic acquiring unit 18 further includes a nozzle characteristic storage unit or a nozzle characteristic detection unit, not shown, so that nozzle characteristic information of the print head 200 can be acquired easily by reading characteristic information of the print head 200 stored in the nozzle characteristic storage unit or reading characteristic information of the print head 200 detected by the nozzle detection unit.

The nozzle characteristic storage unit is composed of a storage unit readable ROM or RAM in which a result of a print head nozzle characteristic test conducted when manufacturing the print head 200 or when assembling the printing device 100 (printing unit 16) is stored, and the print head characteristic detection unit is adapted to inspect the characteristics of the print head 200 from the printed result of the print head 200 using an optical printed result reading unit such as scanning unit regularly or at a predetermined timing and stores the result of inspection together with the data in the nozzle characteristic storage unit or by overwriting the same on the data in order to cope with change in characteristics of the print head 200 after usage. The characteristics of the print head 200 are fixed in the manufacturing stage to some extents, and are considered that they change relatively rarely after manufacture except for a case of failure discharge due to clogging of ink.

The selection information generating unit 19 generates selection information required for selecting the usable nozzles from nozzle information acquired by the nozzle characteristic acquiring unit 18. The selecting method will be described in detail later.

The nozzle selecting unit 20 is adapted to provide a function to select one of the nozzles from each nozzle array of the print head 200 for each nozzle row that is arranged in the fore-and-aft direction with respect to the printing direction as a usable nozzle on the basis of the selection information generated by the selection information generating unit 19. A detailed example will be given later.

The print head controlling unit 22 is adapted to control the print head 200 (printing unit 16) so that only the usable nozzles selected by the nozzle selecting unit 20 are used when printing is performed by the printing unit 16.

Figure 2:
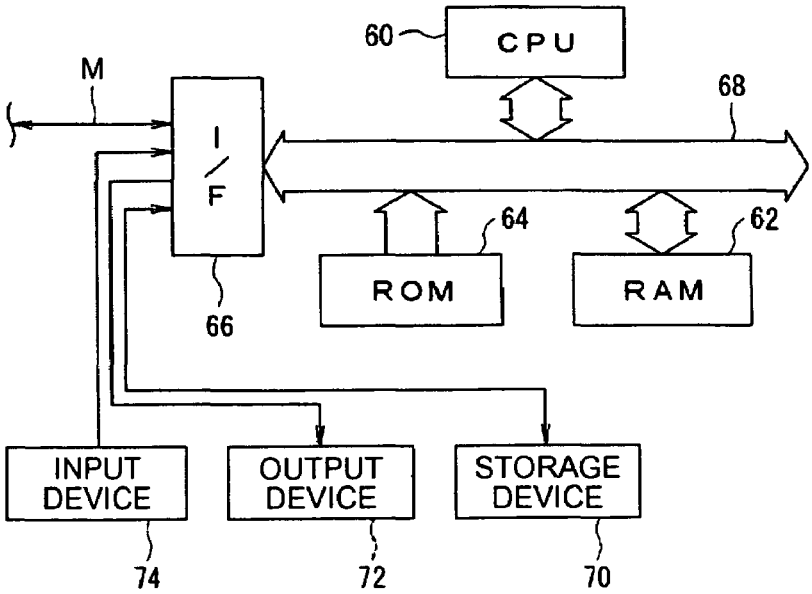
FIG. 2 is a block diagram showing a hardware structure of a computer system that realizes the printing device according to the invention.

The printing device 100 includes a computer system for realizing various control for printing, the image data acquiring unit 10, N-level data generating unit 12, the print data generating unit 14, the printing unit 16, the nozzle characteristics acquiring unit 18, the nozzle selecting unit 20, the print head controlling unit 22, etc., on the software. The hardware structure thereof is composed of a CPU (Central Processing Unit) 60 in charge of various controls or computing process, a RAM (Random Access Memory) 62 that constitutes a main storage and a ROM (Read Only Memory) 64 as a storage device specific for reading connected to each other with various internal and external buses 68 such as a PCI (Peripheral Component Interconnect) bus or an ISA (Industrial Standard Architecture) bus, and a secondary storage 70 such as an HDD (Hard Disk Drive), an output device 72 such as the printing unit 16, a CRT, an LCD monitor, an input device 74 such as an operating panel, a mouse, a keyboard, and a scanner, and a network M for communicating with the print instruction device, not shown, are connected to the bus 68 via an input/output interface (I/F) 66, as shown in FIG. 2.

When a power is supplied, a system program such as BIOS stored in the ROM 64 or the like loads various specific computer programs stored in the ROM 64 in advance or various specific computer programs installed in the storage device 70 via a recording medium such as a CD-ROM, a DVD-ROM or a flexible disk (FD) or via the communication network M such as internet in the RAM 62, and then the CPU 60 executes a predetermined control and the computing processes using various resources according to command described in the programs loaded in the RAM 62, whereby the various functions of the respective unit as described above can be realized on the software.

Subsequently, an example of a flow of a printing process using the printing device 100 in this configuration will be described referring mainly to flowcharts in FIG. 8 and FIG. 9.

FIG. 8 shows a general flow of the printing process in the printing device 100.

As shown in the chart, when a predetermined initial operation for the printing process is completed after the power is turned on, the printing device 100 goes to a first step Step S100. If a print instruction terminal, not shown, such as a personal computer or a printer server is connected, the image data acquiring unit 10 monitors whether or not there is an explicit print instruction from the print instruction terminal. When it is determined that the printing instruction is supplied (Yes), the procedure goes to the next step Step S102, where whether or not multi-level (M-level) image data to be printed is supplied from the print instruction terminal together with the print instruction is determined.

When it is determined that the predetermined image data is not sent after a predetermined period is elapsed (No), the procedure is ended. When it is determined that the predetermined image data is sent within the predetermined period (Yes), the procedure goes to the next step Step S104.

In Step S104, the sent image data is converted into the N-level by the N-level data generating unit 12 to generate the N-level data of four levels as shown in the dot/gradation conversion table 300 in FIG. 7. When the print head 200 is capable of color printing, and the image data acquired by the image data acquiring unit 10 is the multi-level RGB data, the image data is converted into the multi-level CMYK (including light magenta and light cyan) data corresponding to the used ink on the basis of a predetermined conversion algorithm as described above, and then the multi-level CMYK data is converted into the N-level.

Subsequently, when the predetermined N-level data is generated in this manner, the procedure goes to the next step Step S106, where the print data is generated by allocating dots of corresponding sizes to the respective pixels as shown in the dot/gradation conversion table 300 in FIG. 7, and the procedure goes to the next step Step S108, where an active nozzle selecting process, which is the characterized part of the invention, is performed.

When the active nozzle selecting process is executed and the usable nozzles are actually selected, the procedure goes to the last step Step S110, where printing is executed on the basis of the print data generated in Step S106 using the print head 200 on which the usable nozzles are determined.

Figure 9:
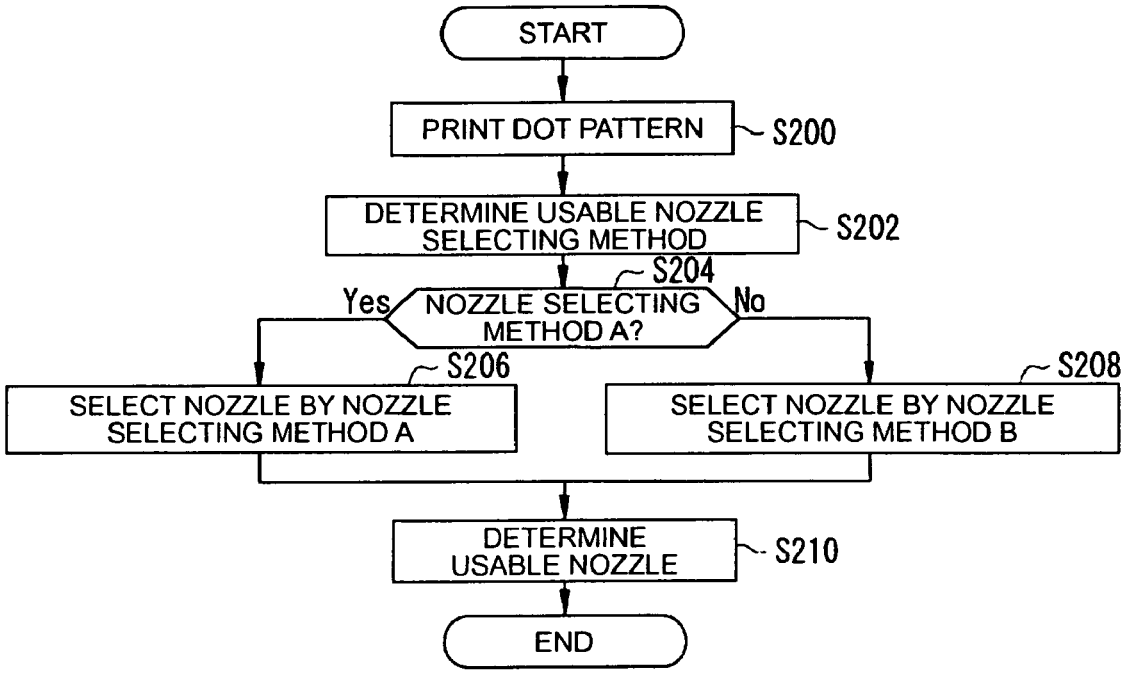
FIG. 9 is a flowchart showing a flow of usable nozzle selecting process according to the first embodiment.

FIG. 9 shows an example of a flow of generation of the nozzle characteristic information for the usable nozzle selecting (determining) process in Step S108.

Figure 10:
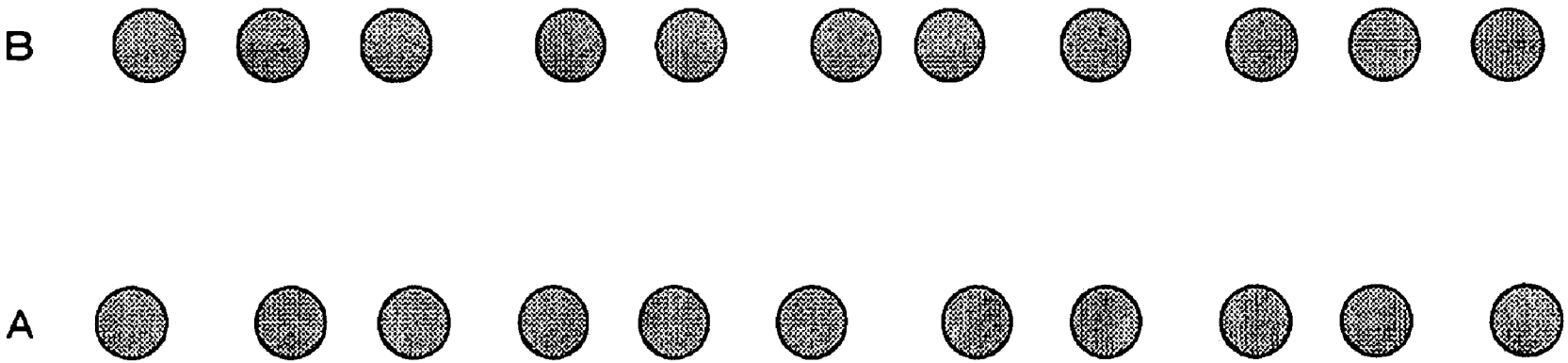
FIG. 10 is a drawing showing an example of a dot pattern (test pattern) of the print head.

In the first step Step S200, a dot pattern (test pattern) of dots of the same size as shown in FIG. 10 is printed using all the nozzles N of the pair of nozzle arrays A and B that constitute the print head 200 so that the nozzle arrays A and B can be separated and observed (The example in FIG. 10 shows a state in which dots of the same size are formed from eleven nozzles each of the respective nozzle arrays A and B).

Subsequently, when the dot pattern printing process of the print head 200 is terminated in this manner, the procedure goes to the next step Step S202, where the usable nozzle selecting method is determined on the basis of the dot pattern printing. Finally, the procedure goes to Step S110, where the print data is printed using the selected usable nozzles.

FIG. 11 to FIG. 15 show examples of the usable nozzle selecting method. In the following description, it is assumed that the selection information generating unit 19 generates information relating to the usable nozzles and the nozzle selecting unit 20 selects the usable nozzles on the basis of the generated information.

Figure 11:
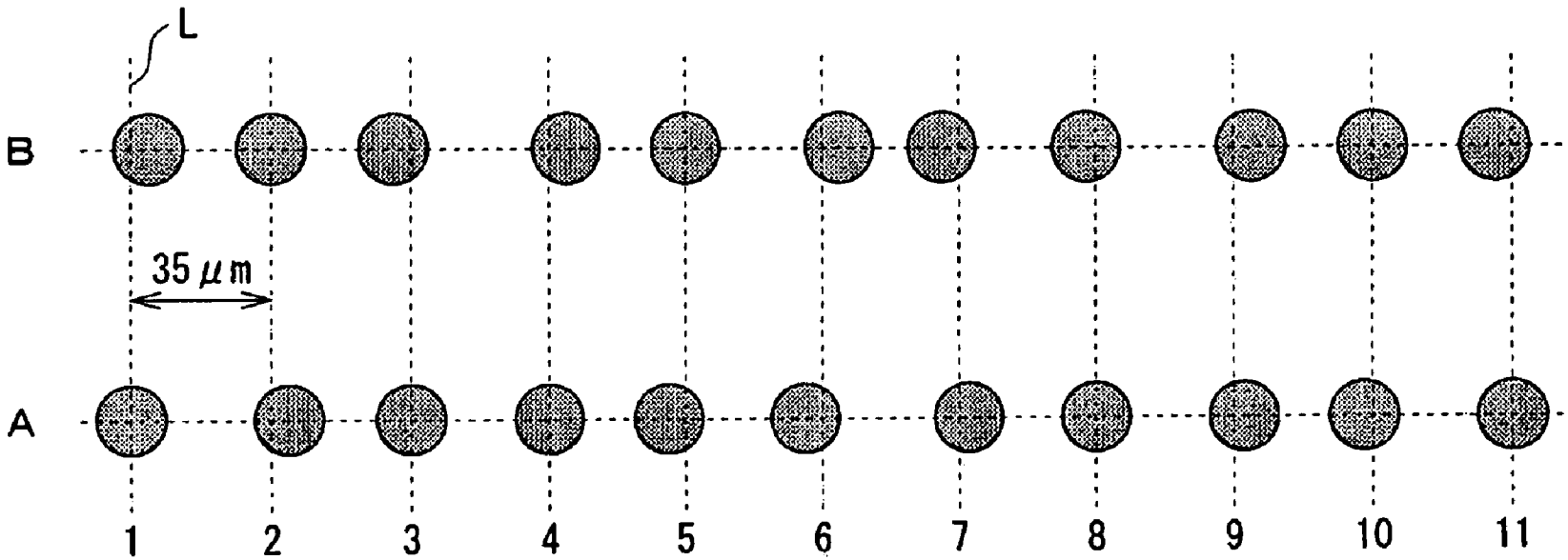
FIG. 11 is a conceptual drawing showing an example of an active nozzle selecting method according to the first embodiment.
Figure 12:
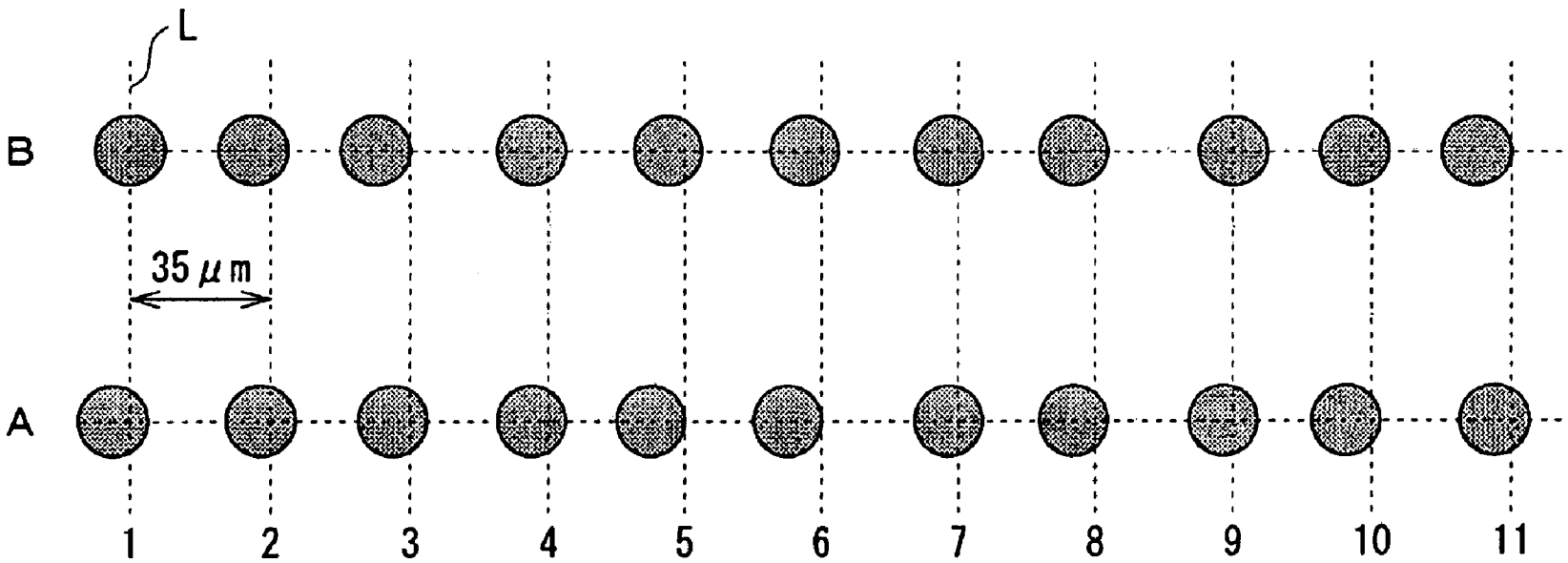
FIG. 12 is a conceptual drawing showing an example of the active nozzle selecting method according to the first embodiment.

FIG. 11 and FIG. 12 show an example of a first usable nozzle selecting method (nozzle selecting method A).

As shown in the drawings, in the first usable nozzle selecting method, firstly, virtual resolution lines L at a regular pitch corresponding to resolution of the print head 200 are assumed in the direction of the nozzle array with reference to a dot located at a left end of the nozzle array A or B.

In other words, the resolution of the print head 200 (inter-nozzle pitch (target pitch)) is 720 dpi, the virtual resolution lines L are assumed at intervals of 35 μm (1 inch (2.54 cm)/720=0.0035 (cm)=35 μm) in the printing direction.

When the virtual resolution lines L of a regular pitch are assumed, dots which are closer to the virtual resolution lines L are selected as optimal dots for the respective virtual resolution lines L, that is, for the respective rows of the dots arranged in the fore-and-aft direction with respect to the printing direction.

In the example shown in FIG. 11, since the virtual resolution lines L are formed with reference to a dot "A1" at the left end of the nozzle array A, the dot "A1" at the left end of the nozzle array A is selected from a row of the dots which corresponds to a first virtual resolution line L1, and a nozzle corresponding to a dot "B2" is selected from a row of the dots corresponding to a next virtual resolution line L2 as the optimal dot since the dot "B2" in the nozzle array B is closer to the virtual resolution line L2. Likewise, a nozzle corresponding to a dot "A3" is selected from a dot row corresponding to a virtual resolution line L3 as the optimal dot since the dot "A3" in the nozzle array A is closer to the virtual resolution line L3.

When the optimal dots are selected for the respective virtual resolution lines L in this manner, in the example in FIG. 11, for example, dots "A1", "B2", "A3", "A4", "B5", "B6", "A7", "A8", "A9", "B10" and "A11" are selected, and the nozzles corresponding to these dots are selected as the usable nozzles.

At this time, the distances between the selected dots and the virtual resolution lines L are integrated as errors. In the example shown in FIG. 11, assuming that the error for "A1" is 0 μm since it is a reference dot, and from this dot on, 1.5 μm for "B2", 1.5 μm for "A3", 2 μm for "A4", 0.5 μm for "B5", 1 μm for "B6", 0.5 μm for "A7", 1 μm for "A8", 2.5 μm for "A9", 0.5 μm for "B10", and 1 μm for "A11", the error is 11 μm.

FIG. 12 shows a case in which the virtual resolution lines L are formed with reference to a dot "B1" at the left end of the nozzle array B. In the example shown in FIG. 12, for example, dots "B1", "A2", "A3", "B4", "B5", "B6", "B7", "B8", "A9", "B10" and "A11" are selected, and the nozzles corresponding to these dots are selected as the usable nozzles.

In this example, assuming that the error for "B1" is 0 μm since it is a reference dot, and from this dot on, 1.5 μm for "A2", 2 μm for "A3", 1 μm for "B4", 4 μm for "B5", 2.5 μm for "B6", 1 μm for "B7", 0 μm for "B8", 1 μm for "A9", 3 μm for "B10", and 2.5 μm for "A11", the error is 18.5 μm.

From the results shown above, since the error is smaller in the case in which the dot "A1" is determined as a reference dot, the dots "A1", "B2", "A3", "A4", "B5", "B6", "A7", "A8", "A9", "B10" and "A11" are selected, and the nozzles corresponding to these dots are selected as the usable nozzles.

Figure 13:
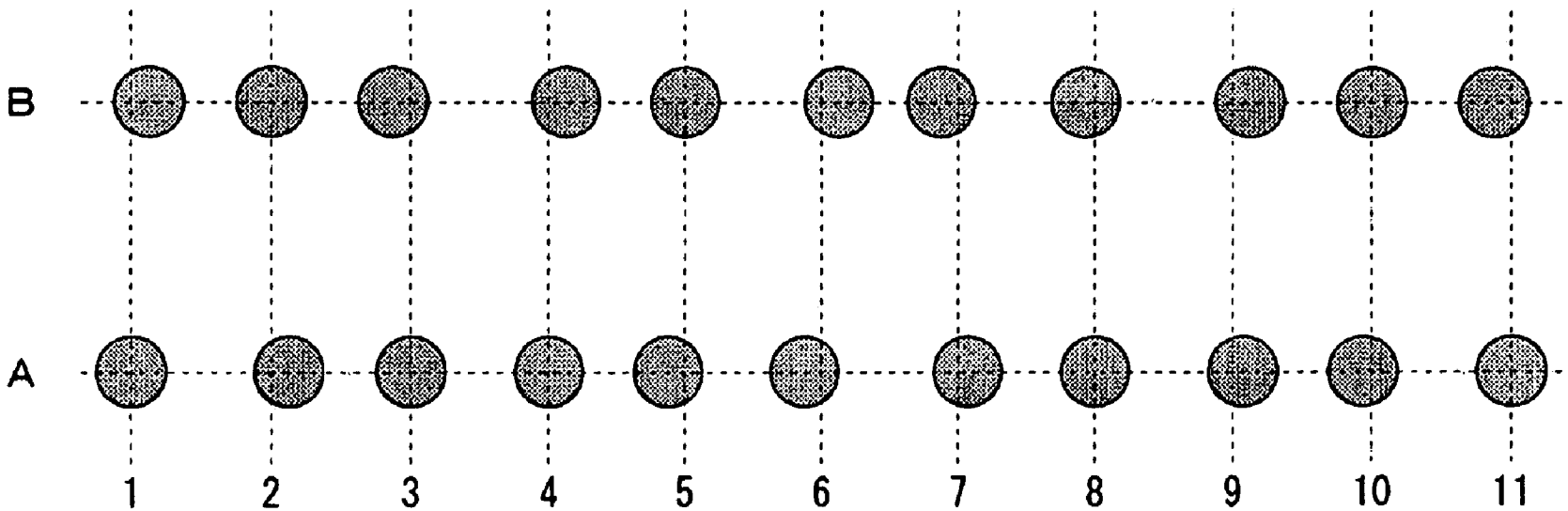
FIG. 13 is a conceptual drawing showing an example of the active nozzle selecting method according to a second embodiment.
Figure 14:
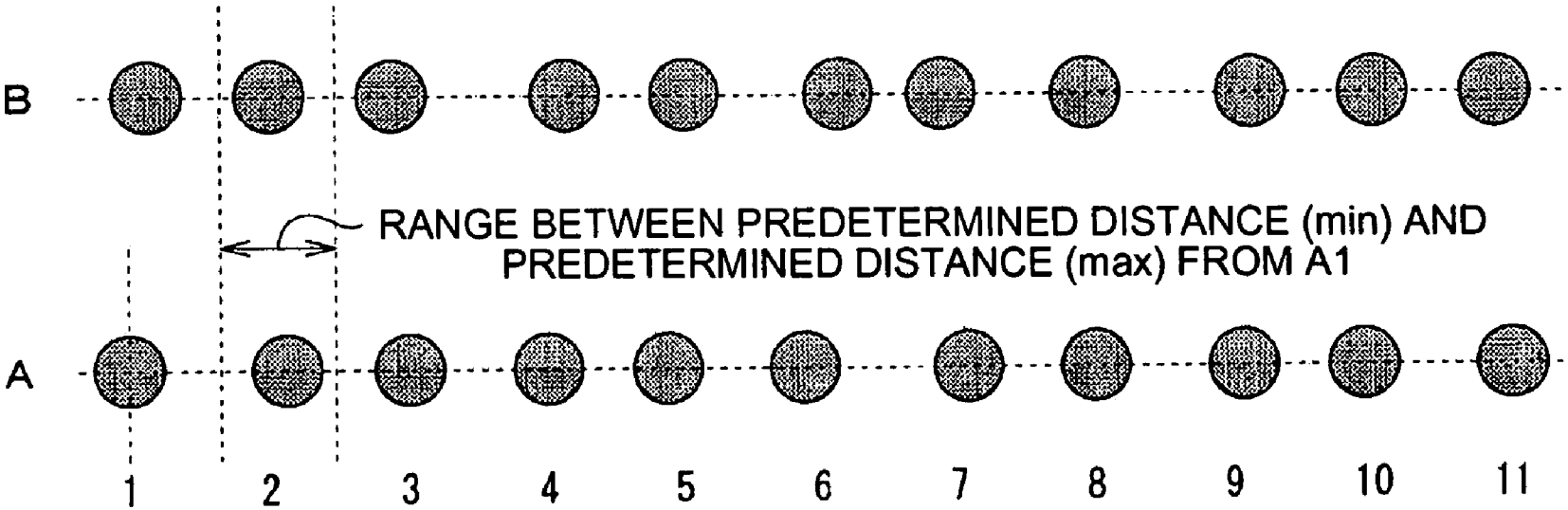
FIG. 14 is a conceptual drawing showing an example of the active nozzle selecting method according to the second embodiment.
Figure 15:
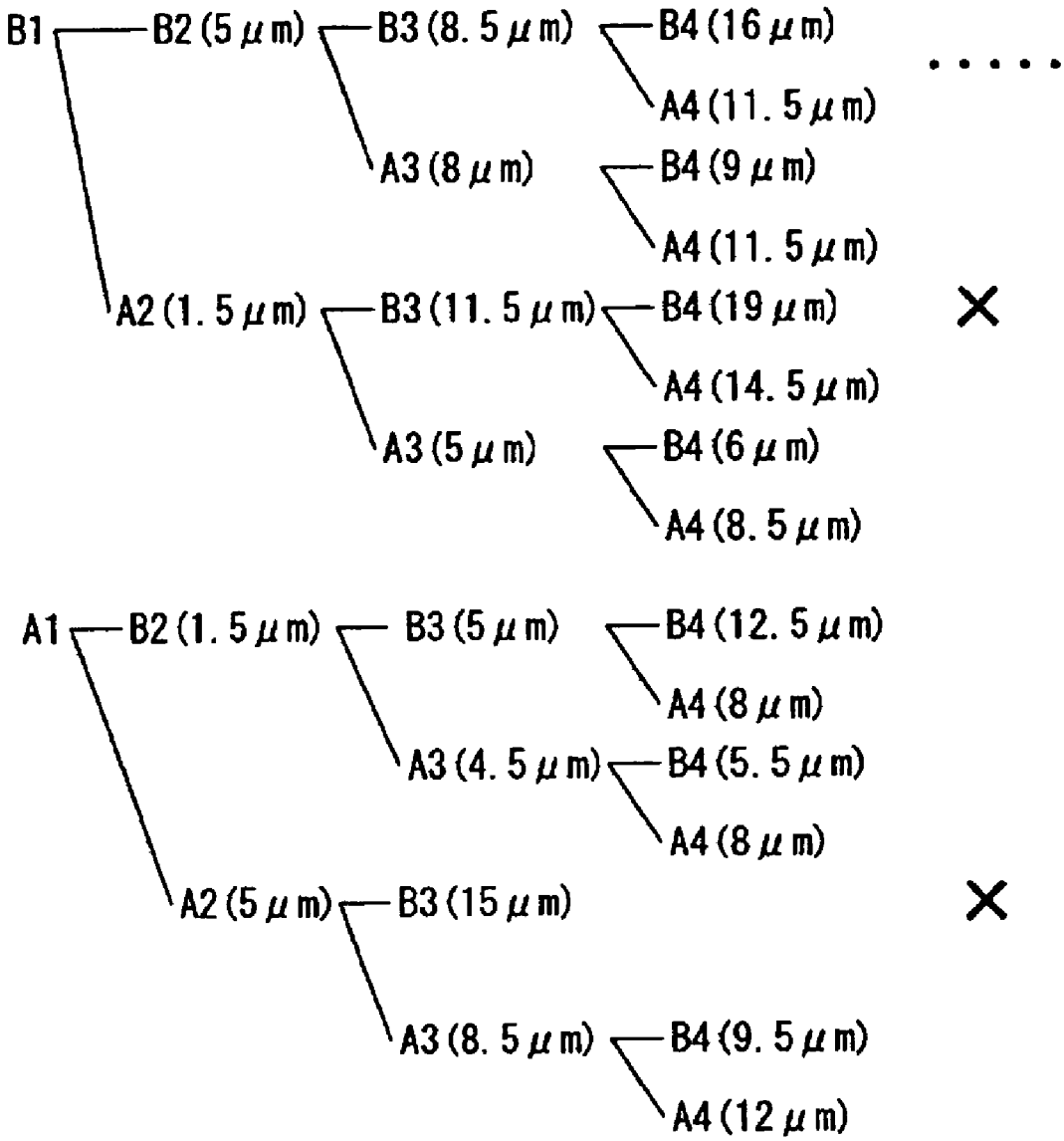
FIG. 15 is a conceptual drawing showing an example of the active nozzle selecting method according to the second embodiment.

FIG. 13 to FIG. 15 show a second usable nozzle selecting method (nozzle selecting method B).

Like. FIG. 11 and FIG. 12 shown above, according to the second usable nozzle selecting method, starting dots located within ranges between predetermined distances (min) and predetermined distances (max) from the first dot "A1" as a reference dot with reference to the dot located at the left end of the nozzle array A or B are added in a tree structure (hierarchically) for the respective nozzle rows in the nozzle array direction, as shown in FIG. 14.

Then, when the dots are added in the tree structure, absolute values of displacement from a resolution of inter-dot distance (target pitch: for example 35 μm for 720 dpi) are integrated into the tree structure as the errors, and if the integrated value of the errors exceeds a threshold, the corresponding pass is ended as the case of a DP matching.

FIG. 15 shows an example in which the errors are integrated in the tree structure. In FIG. 15, a value 6 μm×the number of arcs (depth of the tree) is determined as a threshold.

In this manner, the respective dots are added in the tree structure, and the nozzles corresponding to the dots that constitute a pass having least error are selected from the passes which is continued to a last dot at a right end in the tree structure as the usable nozzles.

The example shown in FIG. 15 shows that the error in a pass "A1"-"A2"-"B3" exceeds a threshold (6×2=12) at a second level from the reference dot, and hence this pass is eliminated from the options first. It also shows that since the error in a pass "B1"-"A2"-"B3"-"B4" reaches a threshold (6×3=18) at a third level from the reference dot, and hence this pass is also eliminated from the options. Among the remaining passes, a pass "A1"-"B2"-"A3"-"B4"-"B5"-"B6"-"A7"-"A8"-"A9"-"A10"-"A11" was the best pass with the integrated error of "16" μm.

Therefore, in the example shown in FIG. 15, the nozzles corresponding to the respective dots that constitute this pass are selected as the usable nozzles.

When a usable nozzle selecting method is specifically determined from the usable nozzle selecting methods A and B in Step S202, the procedure goes to the next determination step Step S204 in the flow in FIG. 9. When the nozzle selecting method A is selected (Yes), the procedure goes to Step S206, where the usable nozzles are selected according to the nozzle selecting method A. When the nozzle selecting method B is selected (No), the procedure goes to Step S208, where the usable nozzles are selected according to the nozzle selecting method B. Then, the procedure goes to the last step Step S210, where the nozzles selected by the selected nozzle selecting method are determined as the usable nozzles.

In this manner, since the two nozzle arrays of the predetermined resolution are provided, and the nozzles in which the discharge deviation phenomenon is not occurred, or the discharge deviation phenomenon is occurred to a smaller extent are selected and used as the usable nozzles according to an aspect of the invention, the discharge deviation phenomenon can be eliminated almost completely, and hence the banding phenomenon such as formation of "white bands" or "dark bands" due to the discharge deviation phenomenon can be eliminated or reduced to an invisible level.

In the first embodiment, the example in which the two nozzle arrays are employed has been described. However, the number of nozzle arrays must simply be at least two, and in general, the more the number of the nozzle arrays, the more efficiently the banding phenomenon caused by the discharge deviation phenomenon can be reduced.

The printing device 100 in the first embodiment corresponds to the printing device shown in Mode 1, and the print head 200 correspond to the print head in the same printing device. The image data acquiring unit 10, the N-level data generating unit 12, the print data generating unit 14, the printing unit 16 in the first embodiment correspond to the image data acquiring unit, the N-level data generating unit, the print data generating unit and the printing unit described in Mode 1. The nozzle characteristic acquiring unit 18, the nozzle selecting unit 20, the print head controlling unit 22 in the first embodiment correspond to the print element characteristic acquiring unit, the print element selecting unit, the print head controlling unit described in Mode 1, respectively. Step S100 and Step S102 in FIG. 8 correspond to the image data acquiring unit of the printing device described in Mode 1, and Step S104 in FIG. 8 corresponds to the N-level data generating unit of the printing device also described in Mode 1, and Step S106 in FIG. 8 corresponds to the print data generating unit of the printing device described also in Mode 1. The Step S108 in FIG. 8 and the flow in FIG. 9 correspond to the print element selecting unit described also in Mode 1, and Step S110 in FIG. 8 corresponds to the printing unit described also in Mode 1.

The characteristics in the aspect of the invention is that since the optimal nozzles are selected and used according to the discharge deviation phenomenon from the nozzle characteristics of the print head without modifying the existing print head 200, the existing printing unit 16 or the existing series of processing from acquisition of the image data to generation of the print data, it is not necessary to provide specific unit additionally as the print head 200, the printing unit 16 and the data processing unit, and hence the inkjet print head 200 or printing unit 16, and the data processing unit existing in the related art can be used without modification.

Therefore, when the print head 200 and the printing unit 16 are separated from the printing device 100 according to the aspect of the invention, the function can be realized only with a general purpose information processing device (image processing device) such as a personal computer. In addition, when the data processing unit such as the image data acquiring unit 10, the N-level data generating unit 12, the print data generating unit 14 are cut off and committed to a separate information processing device, further rapid processing is enabled.

The invention can be applied not only to the discharge deviation phenomenon, but also to a case in which the direction of ink discharge is vertical (normal) but the positions where the nozzles are formed are displaced from the normal positions and hence the same dot formation as the discharge deviation phenomenon is resulted in completely the same manner as a matter of course.

The printing device 100 according to the aspect of the invention can be applied not only to the line-head type inkjet printer, but also to the multi-pass type inkjet printer.

Figure 16A:
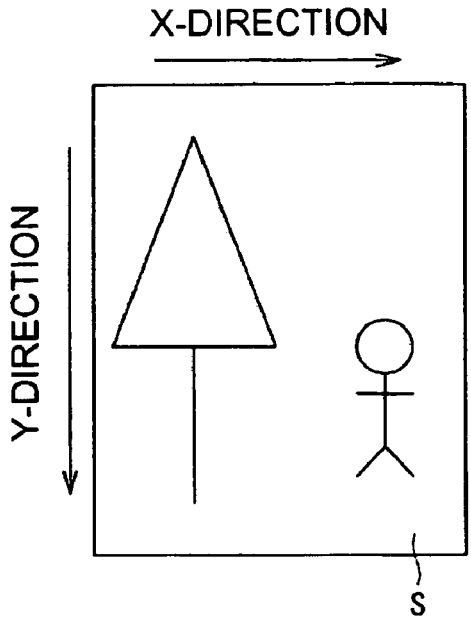
FIG. 16 is an explanatory drawing showing difference in printing method between a multi-pass type inkjet printer and a line-head type inkjet printer.
Figure 16B:
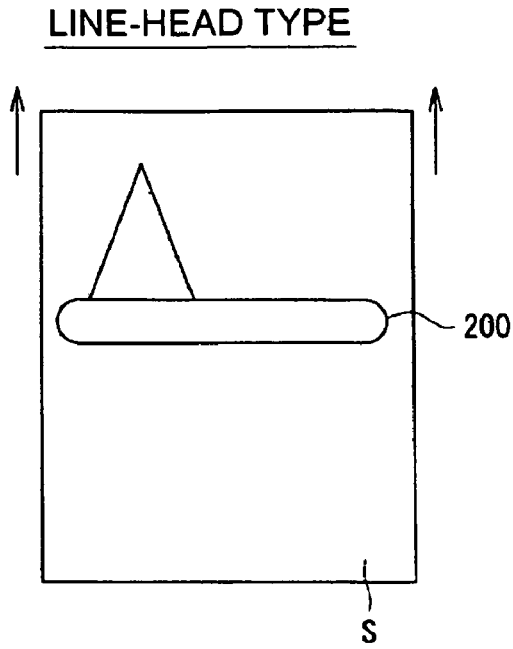
Figure 16C:
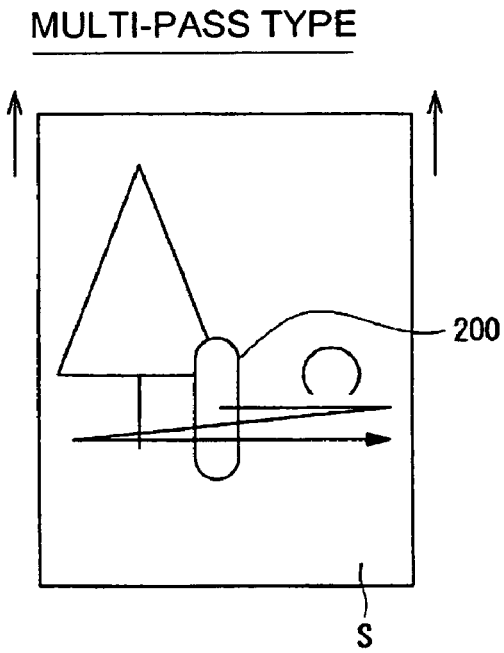

FIGS. 16A, 16B and 16C show printing methods using the line-head type inkjet printer and the multi-pas type inkjet printer respectively.

As shown in FIG. 16A, the direction of the width of the square printer sheet S is assumed to be an X-direction of the image data, and the longitudinal direction thereof is assumed to be a Y-direction of the image data. As shown in FIG. 16B, in the line head type inkjet printer, the print head 200 has a length corresponding to the width of the printer sheet S, and printing is completed by so-called single-pass (operation) by fixing the print head 200 and moving the printer sheet S in the Y-direction with respect to the print head 200. It is also possible to perform printing by fixing the printer sheet S and moving the print head 200 in the Y-direction, or while moving both members in the opposite directions as in a case of a so-called flat-bed scanner. In contrast, in the multi-pass type inkjet printer, printing is performed by positioning the print head 200 which is significantly shorter than the length which corresponds to the width of the sheet in the direction (Y-direction) orthogonal to the X-direction, and moving the printer sheet S in the Y-direction by a predetermined pitch while reciprocating the same in the X-direction many times as shown in FIG. 16*c*. Therefore, the latter multi-pass type inkjet printer has a drawback such that it requires longer printing time than the former line-head type inkjet printer, while the number of nozzles (arrays) to be provided, that is, the number of useless nozzles is small, and hence the advantages of the invention can be achieved more economically.

Although the example of the inkjet printer that performs printing by discharging ink into dots has been described in the first embodiment, the invention can be applied also to other printing devices in which a print head of a mode having printing mechanism arranged in line is employed, such as a thermal head printer, which is referred to as a thermal transfer printer or a thermal printer.

Figure 17:
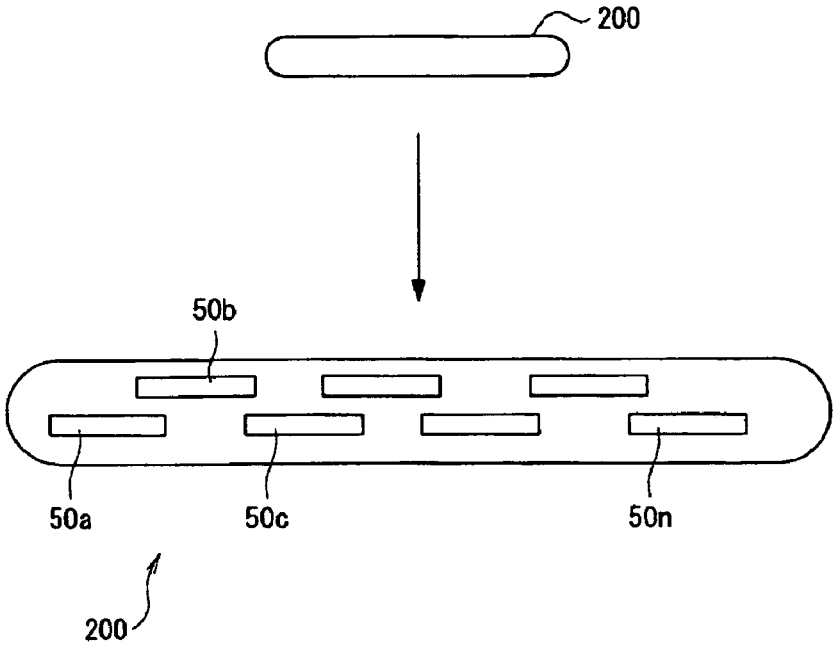
FIG. 17 shows a conceptual drawing showing another example of the structure of the print head.

Although the respective nozzle arrays A and B provided on the print head 200 are in the form having the nozzles N continued linearly in the longitudinal direction of the print head 200 in FIG. 3, a structure in which these nozzle arrays A and B are composed of a plurality of short nozzle units 50*a*, 50*b*, . . . 50*n* arranged in the front and back in the direction of movement of the print head 200 as shown in FIG. 17 may be employed.

In particular, by providing the plurality of short nozzle units 50*a*, 50*b*, . . . 50*n* for the respective nozzle arrays A and B as described above, a process yield is improved significantly in comparison with the case of being configured with the long nozzle unit.

Figure 18:
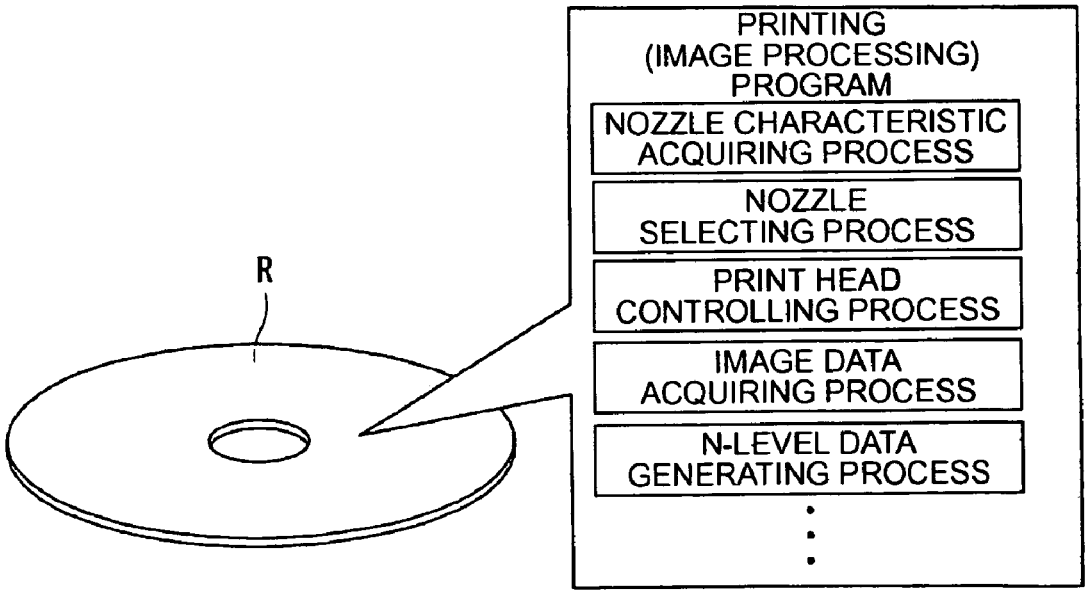
FIG. 18 is a conceptual drawing showing an example of a computer readable recording medium in which a program according to the invention is stored.

The respective unit for realizing the printing device 100 described above can be realized on a software using a computer system integrated in most of the existing printing device, and the computer program can be provided easily to a desired user by integrating in a project in a state of being stored in a semiconductor ROM in advance, distributing via a network such as internet, or via a computer readable recording medium R such as CD ROM, DVD-ROM, or FD as shown in FIG. 18.

FIG. 19 to FIG. 23 show a second embodiment of the printing device 100, the printing program, the printing method, the image processing device, the image processing program, and the image processing method in an aspect of the invention.

Figure 19:
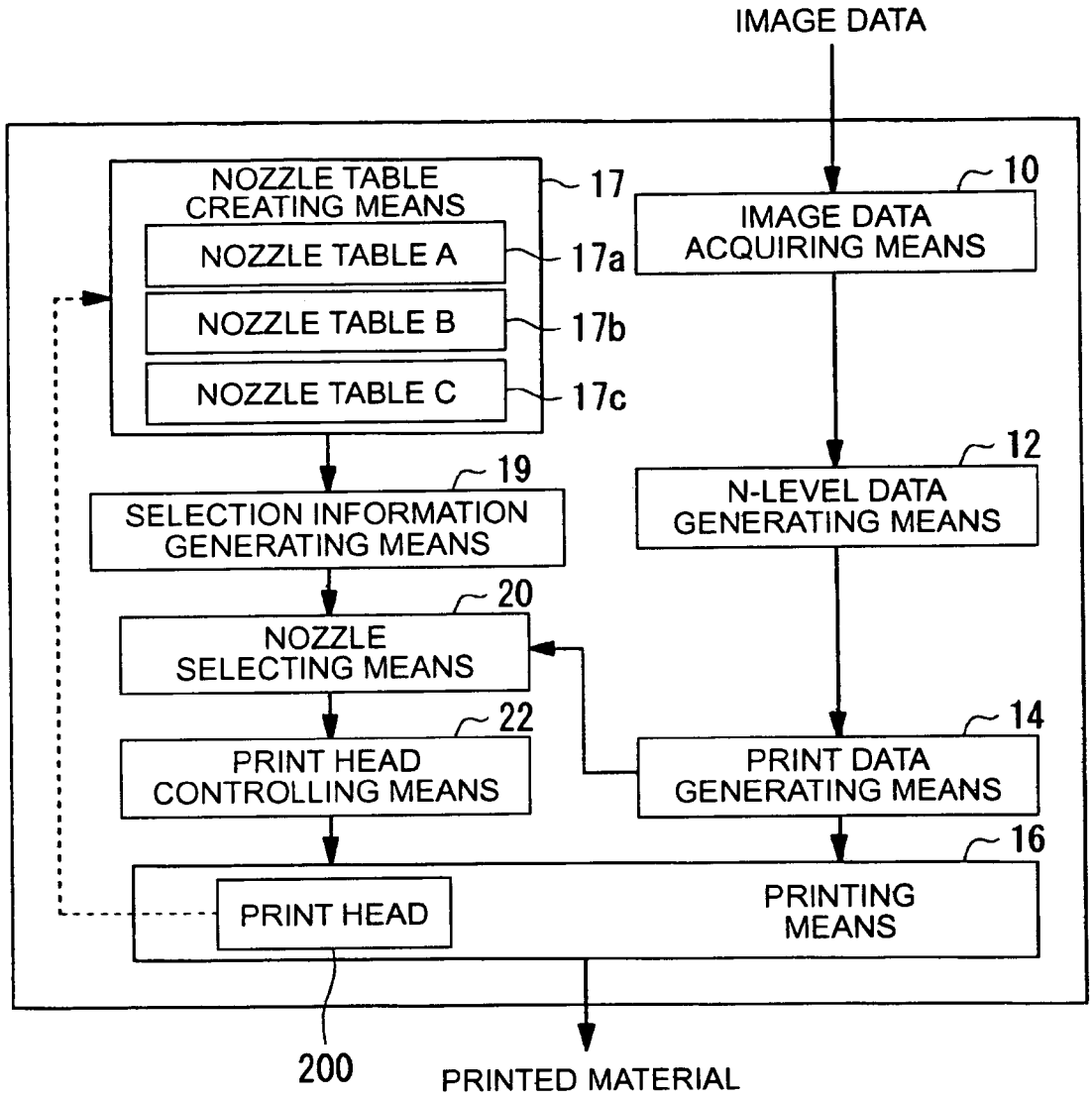
FIG. 19 is a functional block diagram showing the second embodiment of the printing device according to the invention.

FIG. 19 is a functional block diagram showing the second embodiment of the printing device 100 according to the aspect of the invention.

As shown in these drawings, the printing device 100 includes the print head 200 having the plurality of nozzles (print elements), the image data acquiring unit 10 that acquires the multi-level image data provided for printing; the N-level data generating unit 12 that generates N-level data by converting the image data acquired by the image data acquiring unit 10 into the N-level ($N \geqq 2$); the print data generating unit 14 that generates the print data from the N-level data generated by the N-level data generating unit 12; the inkjet printing unit 16 that executes printing on the basis of the print data generated by the print data generating unit 14; nozzle table creating unit 17 that creates a nozzle table for each dot on the basis of the nozzle characteristics of the print head 200; the selection information generating unit 19 that generates the selection information for selecting the nozzles on the basis of the nozzle table created by the nozzle table creating unit 17; the nozzle selecting unit 20 for selecting the usable nozzles on the basis of the selection information generated by the selection information generating unit 19, and the print head controlling unit 22 that controls the print head 200 so that only the usable nozzle selected by the nozzle selecting unit 20 is used.

The structure and other functions of the print head 200, the image data acquiring unit 10, the N-level data generating unit 12, the print data generating unit 14, the printing unit 16, the print head controlling unit 22 are the same as the printing device 100 in the first embodiment, descriptions thereof are omitted, and only the nozzle table creating unit 17 and the nozzle selecting unit 20 will be described.

The nozzle table creating unit 17 is adapted to provide a function to create a plurality of usable nozzle tables in which the usable nozzles are described for the respective dot sizes on the basis of the nozzle characteristics of the print head 200.

In other words, in the first embodiment, under the prerequisite that the amount of discharge deviation is constant for the individual nozzle irrespective of the dot sizes, the usable nozzles are selected and determined without considering specifically the dot size. However, actually, there is a case in which the amount of discharge deviation varies according to the dot size. Therefore, in the second embodiment, the dot size is also considered to select optimal usable nozzles.

In order to do so, in the second embodiment, the usable nozzles are selected for the individual dot sizes by the nozzle table creating unit 17, and are stored in the storage device so as to be capable of writing and reading freely as the usable nozzle table.

When the usable dot size in the second embodiment is composed of three types ("large", "medium" and "small") except for "no dot" as described above, the nozzles are selected for the respective dot sizes using the nozzle selecting method as described in the first embodiment, and stored respectively in the usable nozzle tables. For example, a best combination of the nozzles when printing in the "small dots" is stored in a usable nozzle table A (17*a*), a best combination of the nozzles when printing in the "medium dots" is stored in a usable nozzle table B (17*b*), and a combination of the nozzles when printing in the "large dots" is stored in a usable nozzle table C (17*c*), respectively.

Subsequently, the nozzle selecting unit 20 obtains the dot size that corresponds to each pixel in the printing data generated by the print data generating unit 14, and the usable nozzle table corresponding to the dot size is extracted from the respective usable nozzle tables created by the nozzle table creating unit 17, and the nozzles corresponding to the pixel are selected according to the contents of the usable nozzle table.

For example, when the dot size corresponding to a certain pixel is the "medium dot", the nozzle row corresponding to the dot of the pixel in question is obtained from a pixel address, then the usable nozzle table B (17*b*) containing the description of the nozzle combination of the "medium dot" is referenced, and then the nozzles in one of the nozzle rows described in the usable nozzle table B (17*b*) are selected in sequence as the usable nozzles of the dot corresponding to the pixel in question.

Figure 20:
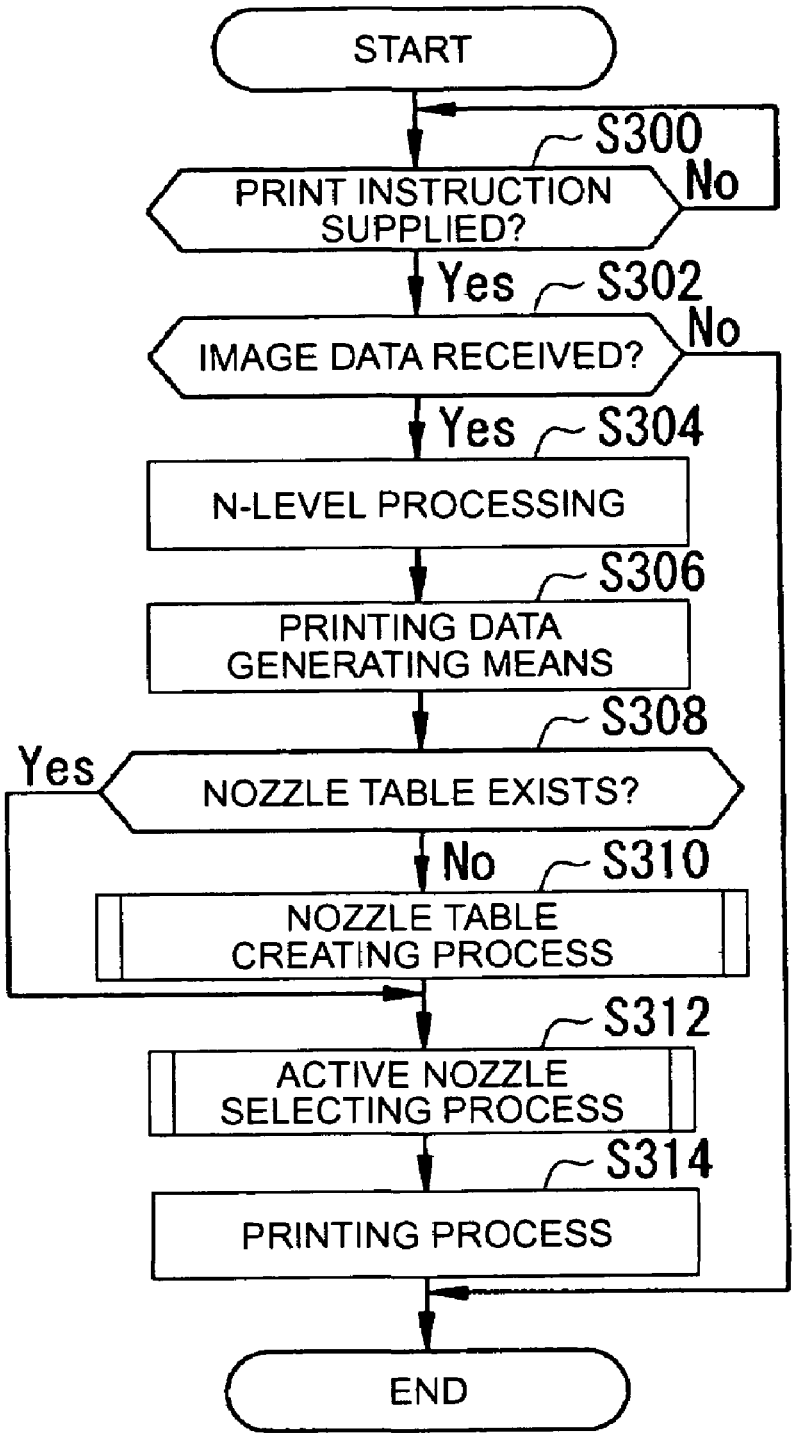
FIG. 20 is a flowchart showing an example of a flow of a process according to the second embodiment.

FIG. 20 is a flowchart showing an example of a flow of printing process according to the second embodiment. Referring now to FIG. 20, the second embodiment will be described. Other prerequisites and structures are the same as the first embodiment unless otherwise specifically described.

As shown in the chart, when the printing device 100 completed a predetermined initial operation for the printing process after the power is turned on, the procedure goes to a first step Step S300. If the print instruction terminal such as the personal computer is connected, the image data acquiring unit 16 monitors whether or not there is an explicit printing instruction supplied from the printing instruction terminal. When it is determined that the printing instruction is supplied (Yes), the procedure goes to the next step Step S302, where whether or not the image data to be printed is sent from the print instruction terminal together with the print instruction is determined.

When it is determined that the image data to be printed is not sent (No), the process is ended. When it is determined that the image data is sent (Yes), the procedure goes to the next step Step S304, where the image data is converted into the N-level to generate the N-level data. Subsequently, the procedure goes to the next step Step S306, where the print data is generated from the N-level data on the basis of the dot/gradation conversion table 300 as shown in FIG. 7.

When the print data in which the predetermined dots are allocated to the respective pixels is generated, the procedure goes to the next step Step S308, where whether the nozzle table for the respective dots corresponding to the print head 200 already exists or not is determined. When it is determined to exist (Yes), the procedure jumps to Step S312, while it is determined not to be generated yet (No), the procedure goes to the next step Step S310, where the usable nozzle tables for the respective dots are created.

Figure 21:
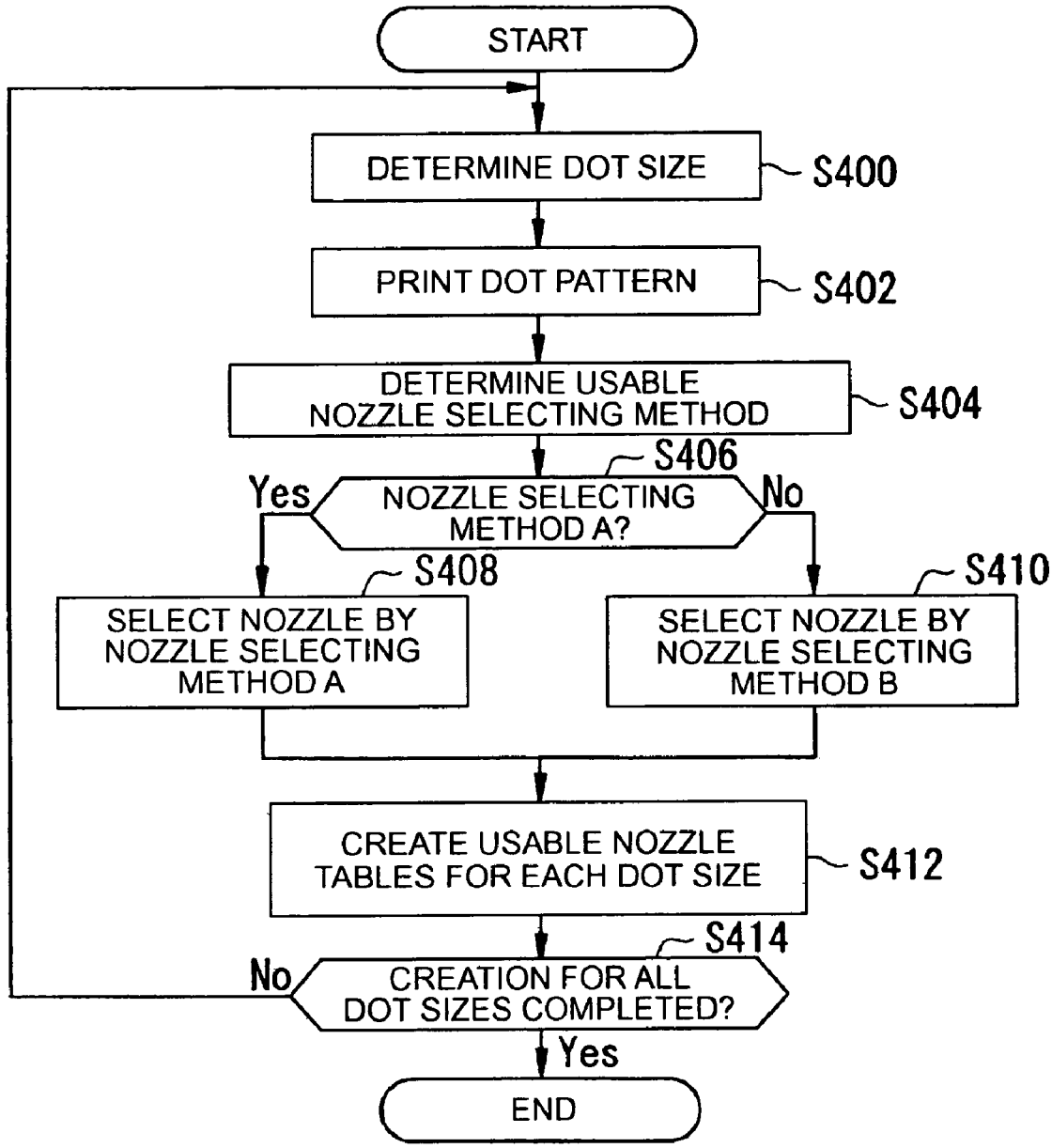
FIG. 21 is a flowchart showing a usable nozzle selecting process according to the second embodiment.

FIG. 21 shows an example of a flow of creating the usable nozzle tables for the respective dots in Step S310.

In the first step Step S400, when the dot size which can be printed by the print head 200, that is, any one of the plurality of dot sizes used in the print data generating unit 14 is determined, the procedure goes to the next step Step S402, where the dot pattern (test pattern) is printed using all the nozzles of the print head 200 as shown in FIG. 10 only with the determined dot size.

Then, in the same manner as the flow in FIG. 9, the procedure goes to Step S404 to Step S410, where the usable nozzle selecting method is determined, and in Step S412, the usable nozzle table corresponding to the determined dot size is created.

When at least one such the usable nozzle table is created in a manner described above, the procedure goes to the last step Step S414, where whether or not the usable nozzle tables are created for all the dot sizes is determined. When it is determined that the usable nozzle tables are created for all the dot sizes (Yes), the procedure is ended. In contrast, when it is determined that the usable nozzle tables are not created for all the dot sizes (No), the procedure goes back to the first step Step S400, where the similar usable nozzle tables are created for all other dot sizes.

When the usable nozzle table creating process is finished in Step S310 in FIG. 20, the procedure goes to the next step Step S312, where an active nozzle selecting process is performed, where optimal nozzles are selected for the respective dots. Then, the procedure goes to the last step Step S314, where the printing process is performed using the selected nozzles, and the process is ended.

Figure 22:
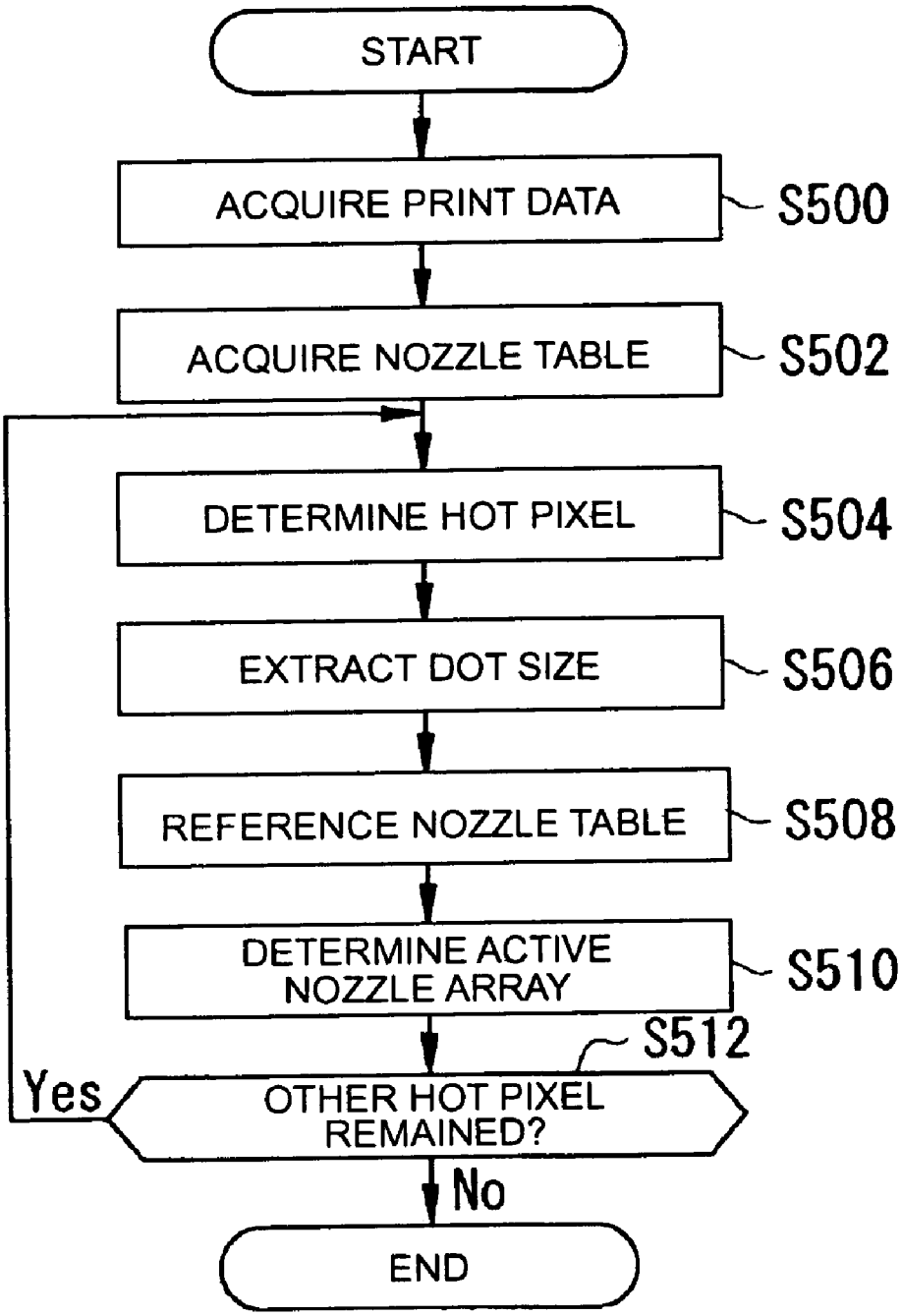
FIG. 22 is a flowchart showing a flow of a usable nozzle array allocating process according to the second embodiment.

FIG. 22 shows an example of a flow of the active nozzle selecting process in Step S312.

When the print data in which dots in the predetermined size are allocated for the respective pixels according to the gradation values (N-level) in the first step Step S500 is acquired, the usable nozzle tables for the respective dot sizes are acquired in the next step Step S502.

Then, the procedure goes to Step S504, where a first pixel of the print data (for example, an upper left pixel in the print data) is determined as a first hot pixel, and in the next step Step S506, the dot size of the hot pixel is extracted.

Subsequently, when the process of determination of the hot pixel and extraction of the dot sizes is ended, the procedure goes to the next step Step S508, where the usable nozzle tables acquired before are referenced, and the nozzle array corresponding to the dot size of the hot pixel is determined.

For example, assuming that the dot size of the upper left pixel of the print data is "small dot", the usable nozzle table of the "small dot" is referenced. Then, as it will be seen that the usable nozzle corresponding to the dot at the upper left, that is, the pixel whose address is "0" is the nozzle array A, it is determined that the hot pixel is to be printed with the nozzle array A.

When the usable nozzle arrays for the hot pixel are determined, the procedure goes to the last step Step S512, where the usable nozzles are determined in the same manner for all the remaining pixels. Then, the print data is handed to the print head controlling unit 22. The print head controlling unit 22 performs printing by the printing unit 16 on the basis of the print data, and the process is ended.

In this manner, according to the second embodiment, in addition to the method in the first embodiment, the amount of discharge deviation which varies according to the dot size is also considered when selecting the usable nozzles. Therefore, even though the amount of data processing is increased in comparison with the first embodiment, the banding phenomenon can be reduced further effectively.

FIG. 23 shows an example of a usable nozzle table 400 for determining the usable nozzles from the address and the dot size of each pixel in the print data. In this example, different from the case in which the usable nozzle tables are provided for the respective dot sizes as in FIG. 19, a single usable nozzle table including the dot sizes is provided.

A 16-digit numeral on an uppermost row of a left column in FIG. 23 indicates addresses (counter) of the respective pixels represented in binary numerals, and a 8-digit numeral on a right side of a partition shown by a broken line in the same column indicates the dot size of the respective pixel expressed by binary numerals. For example, it is shown that the address of the pixel on the uppermost row on the left column of the same drawing is "0000 0000 0000 0000", and the dot size thereof is "0000, 0001" (small dot). In the example in the drawing, there are four dot sizes including "no dot", and "0000 0000" designates "no dot", "0000 0010" designates "middle dot", and "0000 0011" designates "large dot" respectively.

A right column in FIG. 23 is data relating to the usable nozzle arrays coordinated for each pixel containing the address and the dot size recorded therein.

For example, when the small dot is extracted at a leftmost pixel, the usable nozzle for the address "0000 0000 0000 0000" and the dot size "0000 0001" (small dot) is referenced in the left column of the usable nozzle table 400. In other words, the usable nozzle for the value "1" obtained by combining the address and the dot size is referenced in the left column of the usable nozzle table 400. Consequently, the usable nozzle that corresponds to the dot of the pixel in question can be found to be "0000-0001"="1" which indicates the nozzle array A from the corresponding right column. In the example shown in the drawing, a nozzle array identifier "0000 0010"="2" indicates the nozzle array B, and a nozzle array identifier "0000 0011"="3" indicates the nozzle array C.

In the second embodiment as well, the existing print head 200 or printing unit 16 of the inkjet system in the related art can be used without modification as in the case of the first embodiment.

Therefore, by separating the print head 200 and the printing unit 16 from the structure shown in FIG. 19, the function can be realized only by the multi-purpose information processing device (image processing device) such as the personal computer.

In addition to the discharge deviation phenomenon, invention can be applied not only to the discharge deviation phenomenon, but also to a case in which the direction of ink discharge is vertical (normal) but the positions where the nozzles are formed are displaced from the normal positions and hence the same dot formation as the discharge deviation phenomenon is resulted in completely the same manner as a matter of course.

The second embodiment can also be applied not only to the line-head type inkjet printer, but also to the multi-pass type inkjet printer.

The nozzle table creating unit 17 in the second embodiment corresponds to the nozzle characteristic acquiring unit 18 in the first embodiment and Mode 4, and the print head 200 corresponds to the print head of the printing device in the first embodiment. The image data acquiring unit 10, the N-level data generating unit 12, the print data generating unit 14, and the printing unit 16 according to the second embodiment correspond to the image data acquiring unit, the N-level data generating unit, the print data generating unit, and the printing unit in Mode 1 respectively, and the nozzle characteristic acquiring unit 18, the nozzle selecting unit 20, and the print head controlling unit 22 according to the second embodiment correspond to the print element characteristic acquiring unit, the print element selecting unit, and the print head controlling unit in Mode 1, respectively. Step S300, and Step S302 in FIG. 20 correspond to the image data acquiring unit in Mode 1, and Step S304 in FIG. 20 corresponds to the N-level data generating unit of the printing device also in Mode 1. The Step S306 in FIG. 20 corresponds to the print data generating unit of the printing device also in Mode 1, and Step S308, Step S310, and Step S312, in FIG. 20 and the flowcharts in FIG. 21 and FIG. 22 correspond to the print element selecting unit and the like in Mode 1, and Step S314 in FIG. 20 corresponds to the printing unit also in Mode 1.

The technique to select proper dot sizes in one printing material as described above is a publicly known technique in the related art and, in particular, is a technique used often when obtaining the printing material for achieving a high printing speed and a high printed image quality in balance. In other words, by reducing the dot size, the high definition image can be obtained, while by reducing the dot size, a high performance in machine accuracy is required. In addition, in order to form a solid image with small dots, a number of dots must be formed. Therefore, by employing the technique to select the proper dot sizes such that the small dot size is employed for the highly detailed image portion and the large dot size is employed for the solid image portion, the high printing speed and the high image quality are achieved in balance.

A technical method for selecting the proper dot sizes can be realized easily, for example, in the case in which a piezoelectric element (piezoelectric actuator) is used in the print head, by controlling the amount of ink discharge by varying voltage applied to the piezoelectric element.

The dot sizes which can be selected by the print head 200 normally used or according to the aspect of the invention generally include, as shown in FIG. 7, four patterns of "large dot", "medium dot", "small dot", "no dot", and a surface ratio is, for example, the "small" dot is designated by "1", the "medium" dot is "twice" and the "large" dot is "three time". However, the sorts of the dot size are not limited thereto, and a method of classifying into 8 patterns is also proposed.

Although the embodiments of the invention have been described thus far, the invention is not limited thereto, and various modifications can be made without departing the scope of the invention.

What is claimed is:

1. A printing device for printing a plurality of dots on a medium used for printing comprising:

a print head having a plurality of print elements for forming dots disposed respectively in a row direction, which is a direction of relative movement thereof with respect to the medium, and in an array direction, which is substantially orthogonal to the row direction, the print elements being capable of printing dots at positions which can be regarded as the same positions on the medium in the row direction;

print element selecting unit that selects any one of the print elements being capable of printing dots at positions which can be regarded as the same positions on the medium in the row direction as a usable print element for each row in the row direction of the print head;

print head controlling unit for controlling the print head so that only the usable print element selected by the print element selecting unit is used; and printing unit for executing printing using the print head controlled by the print head controlling unit.

2. The printing device according to claim 1, wherein the printing device comprises selection information generating unit that generates information for selecting usable print elements by determining any one of dots as a reference from a pattern of dots formed by the print elements of the print head in the array direction, assuming vertical resolution lines at regular pitch in the array direction according to resolution of the print head, and selecting print elements corresponding to dots which are closer to the respective virtual resolution lines as the usable print elements for the respective rows in the row direction.

3. The printing device according to claim 2, wherein the selection information generating unit generates information about the print elements for the respective dot sizes so that the respective print elements of the print head can print dots in different sizes, and the print element selecting unit can select the usable print elements for the respective dot sizes from the print head.

4. The printing device according to claim 1, wherein the printing device comprises selection information generating unit that generates information for electing usable print elements by determining any one of dots as a reference from a pattern of dots formed by the print elements of the print head in the array direction, assuming vertical resolution lines at regular pitch in the array direction according to resolution of the print head, obtaining absolute values of amounts of displacement from the respective virtual resolution lines for the respective rows in the row direction, combining the absolute values of the respective dots in the array direction into a tree structure, and selecting print elements corresponding to a combination of dots whose sum of the absolute values is the smallest as the usable print element.

5. The printing device according to claim 1, wherein the print head is a line-head type print head having a length corresponding to a width of the medium so that printing can be achieved by a single scan without being moved in widthwise of the medium.

6. The printing device according to claim 1, wherein the print head is a multi-pass type print head having a length shorter than the width of the medium and reciprocates widthwise of the medium.

7. A printing method for performing a printing operation by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction comprising:

a print element selecting step that selects any one of the print elements as a usable print element for each row in the row direction of the print head;

a print head controlling step that controls the print head so that only the usable print element selected by the print element selecting step is used; and a printing step that executes printing using the print head controlled by the print head controlling step.

8. An image processing device that forms an image by using a print head having a plurality of print elements for forming dots disposed respectively in a row direction, which is a direction of relative movement thereof with respect to a medium used for printing, and in an array direction, which is substantially orthogonal to the row direction, the print elements being capable of printing dots at positions which can be regarded as the same positions on the medium in the row direction comprising:

print element selecting unit that selects any one of the print elements being capable of printing dots at positions which can be regarded as the same positions on the medium in the row direction as a usable print element for each row in the row direction of the print head; and print head controlling unit that controls the print head so that only the usable print element selected by the print element selecting unit is used.

* * * * *